US005720465A

United States Patent [19]

Peltzer et al.

[11] Patent Number: 5,720,465

[45] Date of Patent: Feb. 24, 1998

[54] MULTI-POSITION READING STAND

[76] Inventors: Eric T. Peltzer, 2857 Reposa La., Altadena, Calif. 91001; Sam Stolzoff, 1310 Gold Ct., Ontario, Calif. 91762

[21] Appl. No.: 575,983

[22] Filed: Dec. 21, 1995

[51] Int. Cl.[6] ..... A47B 97/04

[52] U.S. Cl. ..... 248/453; 248/455; 248/464

[58] Field of Search ..... 248/451, 452, 248/453, 455, 464

[56] References Cited

U.S. PATENT DOCUMENTS

| | | | |
|---|---|---|---|
| 1,286,018 | 11/1918 | Jones | 248/455 |
| 1,692,337 | 11/1928 | Forbes . | |
| 2,156,225 | 4/1939 | O'Meara | 45/80 |
| 2,538,318 | 1/1951 | Mitchell | 248/455 X |
| 2,638,300 | 5/1953 | De Jen | 248/464 |
| 2,741,869 | 4/1956 | Aibel | 45/82 |
| 3,140,558 | 7/1964 | Cassidy | 248/448 X |
| 3,147,948 | 9/1964 | Evanoff | 248/455 |
| 3,198,475 | 8/1965 | Flahive | 248/445 |
| 3,514,066 | 5/1970 | Singleton et al. | 248/445 |
| 3,889,914 | 6/1975 | Torme | 248/445 |
| 3,894,709 | 7/1975 | Weir | 248/445 |
| 3,952,989 | 4/1976 | Hatcher | 248/453 |
| 3,991,967 | 11/1976 | Sack | 248/453 X |
| 5,016,852 | 5/1991 | Herenden | 248/455 X |
| 5,025,353 | 6/1991 | Menaged | 248/453 X |
| 5,161,766 | 11/1992 | Egashira et al. | 248/464 X |
| 5,205,526 | 4/1993 | Deutsch | 248/464 X |
| 5,351,927 | 10/1994 | Howell | 248/444.1 |
| 5,393,029 | 2/1995 | Senko | 248/447 |
| 5,433,415 | 7/1995 | Samson et al. | 248/448 |
| 5,445,416 | 8/1995 | Zareck | 281/42 |

FOREIGN PATENT DOCUMENTS

| | | | |
|---|---|---|---|
| 117287 | 2/1901 | Germany | 248/453 |
| 295415 | 11/1916 | Germany | 248/453 |
| 329011 | 11/1920 | Germany | 248/453 |
| 25579 | 6/1903 | United Kingdom | 248/453 |

OTHER PUBLICATIONS

"Reader's Table", Levenger Co., 420 Commerce Drive, Delray Beach, Fl. Model FR500 (Shaun in Christmas 1995 Catalog).

"Folding Oak Bookstand", Levenger Co., Model#B5040 (Same Catalog as Previous Reference).

*Primary Examiner*—Leslie A. Braun
*Assistant Examiner*—Gwendolyn W. Baxter

[57] ABSTRACT

A compact portable reading stand, which serves to hold a book open in a number of positions, with a rigid backing plate having a lower slide raft. On this rail slide positionable spring-loaded page clamps which hold book pages open by pressing against outer page margins. Two adjustable arms mounted on the lower rear corners of backing plate, along with a third telescoping, pivoting and rotating leg, allow book stand to be raised off a table top, positioned sideways for reading in bed, or raised above an arm chair. May be attached to a floor stand or other bracket for positioning book over a bed or above a chair or desk. Detachable reading light may be attached behind lower slide rail.

1 Claim, 13 Drawing Sheets

FIG. 7A
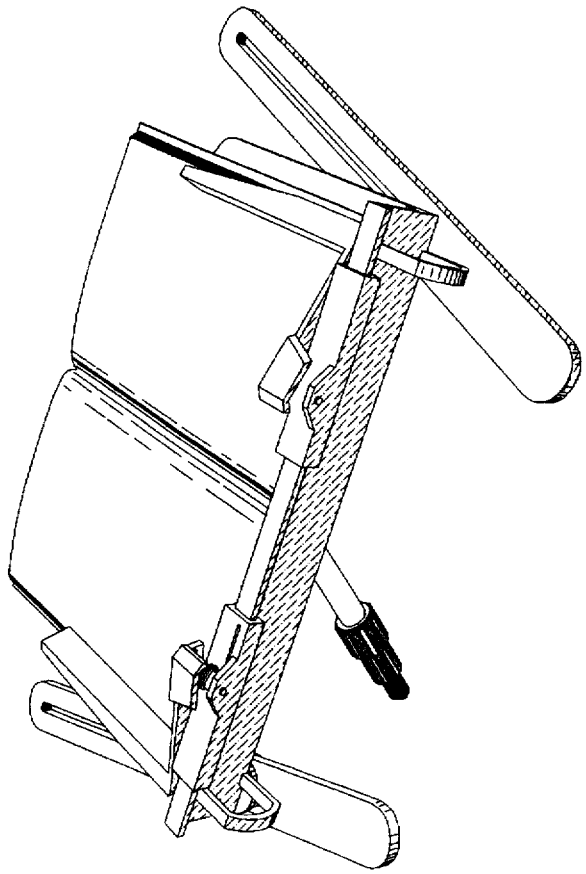
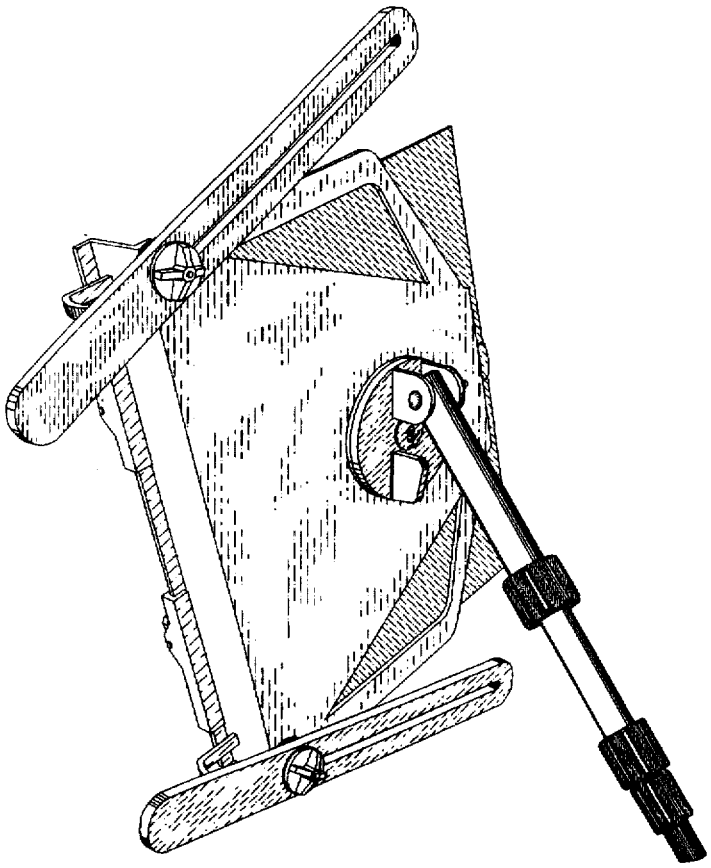
FIG. 7B

FIG. 8A
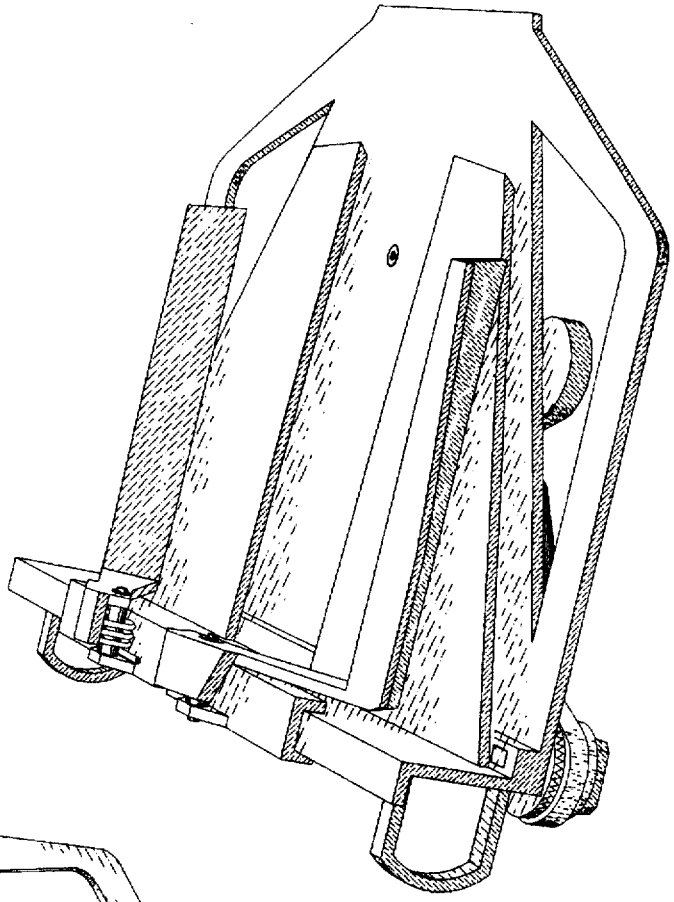
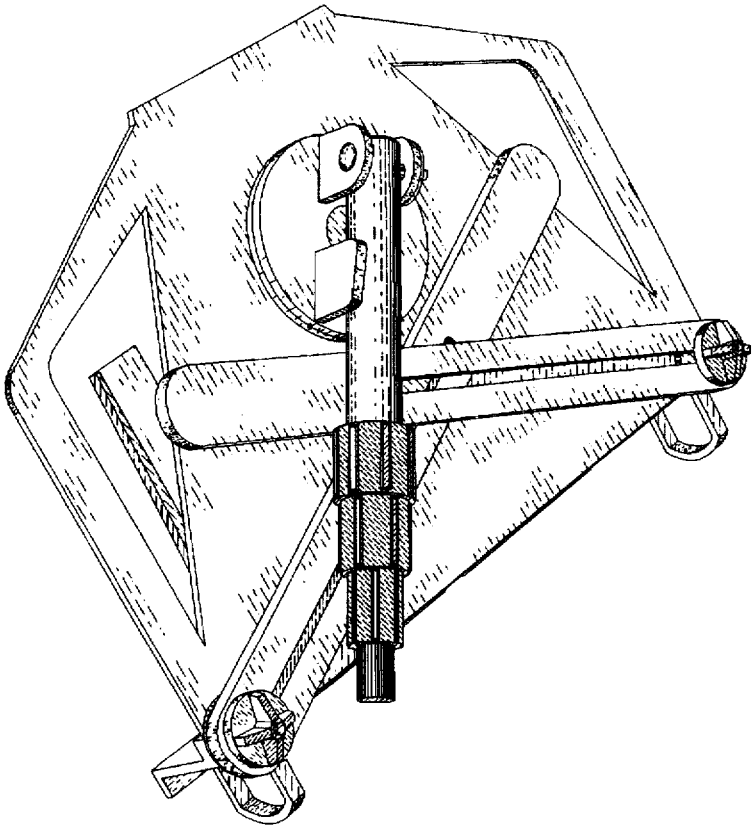
FIG. 8B

FIG. 12A
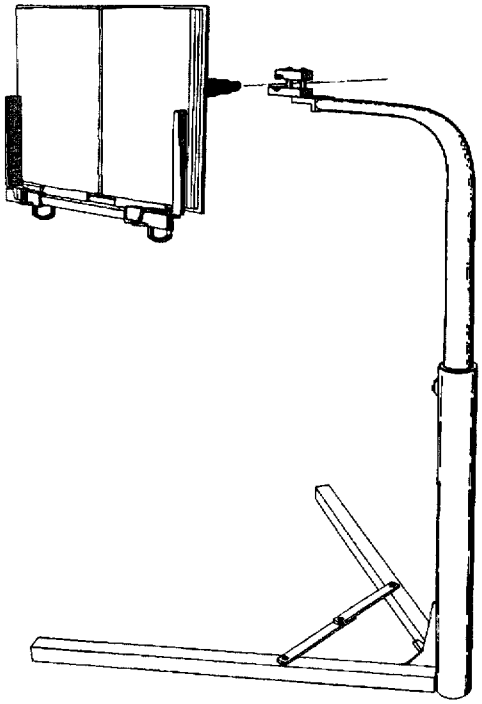
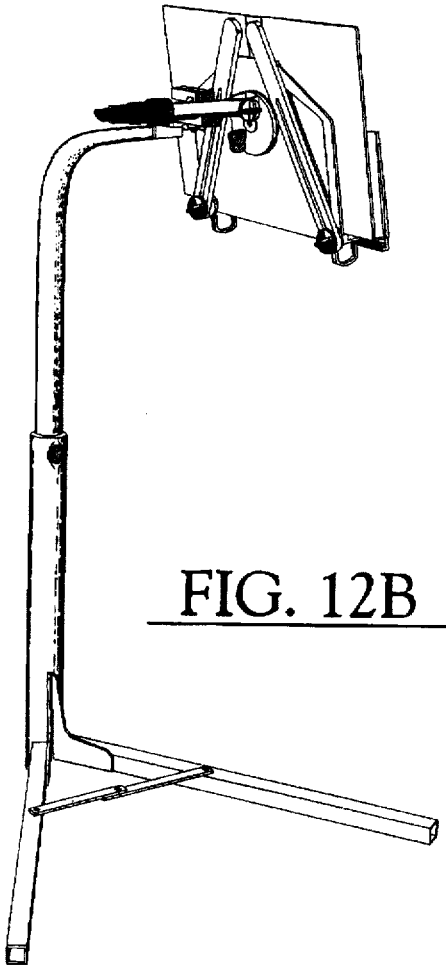
FIG. 12B
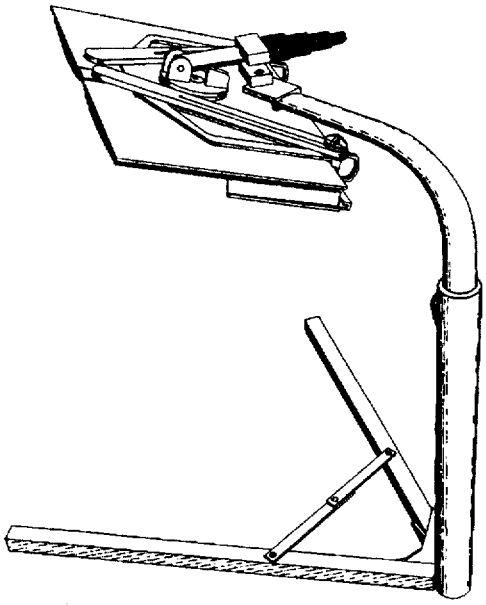
FIG. 12C

MULTI-POSITION READING STAND

BACKGROUND—FIELD OF INVENTION

This invention relates to book supports or reading stands, specifically, to such stands for holding a book or other reading material in various positions with pages open.

BACKGROUND—PRIOR ART

The average reader, today and since the very advent of the book, has had a tedious task. The book must be held open and in from of the face with one or both hands, constantly. Pressing the book down against a table or cradling it in the lap offers a change of position, but the fingers and hands are continually pressed into service. Simply getting up for a brief respite means setting the book down and searching for a book mark to foil the insistently closing pages. Reading in the usual manner for any length of time quickly becomes uncomfortable. If people endure this discomfort, it is no doubt only because there has been no practical alternative. Students, for instance, must spend their daily hours constantly pressing against pages, propping the book in various positions, seeking adequate illumination, and trying to avoid a neck-ache. Reading in bed, such an attractive prospect, is a constant squirming battle from one's right side, to one's left side, to holding the book for a short while above one's face, to reclining up against the headboard—to say nothing of the problem of adequate illumination.

The problem is almost universal in scope. Anyone who reads is certain to have encountered a good deal of discomfort or frustration while reading. At the risk of over-stating the obvious, reading is one of the most basic daily necessities in any non-primitive society, and is moreover still one of the world's most popular amusements. The vast majority of readers continue to read unaided by any book support, page restraint, book light or other device whatsoever. Perhaps the only inventions thus far to further the cause of comfortable and efficient reading have been eyeglasses and the electric light. As witness to this, we offer the simple observation that there exists today no design or product in widespread use that solves the problem in any significant and practical way.

Any device that could be put into widespread use to alleviate such discomfort and inconvenience would make a significant contribution to the ability of human beings to enjoy reading, to read more efficiently, and, therefore, to learn and communicate.

Despite these facts, prior devices attempting to aid the reader and relieve some of the discomfort and inconvenience have not taken hold in the marketplace. This is typically due to inadequacy of function, awkwardness, limited purpose, or high cost.

There are a number of simple book holders available commercially which will bid a book in a more upright position on a table, for instance. One such product is the Levenger Model #BS040, offered by the Levenger Co. of Delray Beach, Fla. This simple stand works well enough with some of the finer hardbound books having flexible spines and pages which naturally tend to stay open. This type of book, unfortunately, is not nearly as common as the cheaper hardbound and paperback varieties, which do not tend to stay open without some external force.

There are also a number of "reader's tables" available which facilitate reading while sitting in an easy chair or while sitting up in bed, such as the Levenger Model #FR500 and the Howell Designs, Inc. "Reader's Window" (which is the object of U.S. Pat. No. 5,351,927, Howell, 1994).

The Levenger FR500 is a fairly unsophisticated tilting tray attached to a floor stand which will slide under a chair or bed. Since the book is held only by gravity to the tray, the reader must look downwards. Like the Levenger BS040, this design works adequately with heavy hardbound books and magazines.

The "Reader's Window" is a more elaborate though similar design which adds the not insignificant ability to hold a book open face-down. This allows a reader to lie in bed facing upwards and read with a book suspended overhead. While the "Reader's Window" will indeed provide for providing more comfortable reading, it has a number of serious drawbacks. It is large, heavy, and not by any means portable. (Books themselves are small, light and eminently portable). It's design dictates that the book holder must necessarily be larger, or at least wider, than the largest book it may hold (which thus precludes a more compact and portable adaptation). The reader must look through a glass or plastic panel, rather than view the book page directly. Finally, it is extremely expensive. The commercially available version is currently offered at $399.00 U.S. This design is simply neither versatile nor inexpensive enough to capture the mass market.

The problem has of course attracted other inventors with clever ideas over the years. Yet none of these patents enjoy any commercial success today, if they ever did. This is no doubt because prior designs for reading stands suffer from a number of deficiencies. They all solve, to various extents, key parts of the problem, while ignoring other vital considerations altogether. For instance, any single ergonomic position, no matter how comfortable, will become uncomfortable if a person is rigidly forced to maintain the position beyond a certain length of time. Still, most prior book supports have been limited to just a few positions of adjustment, or to only one or two locations or body positions.

Any prior design can be found to suffer from at least one and frequently many of the following shortcomings:

a) It is awkward, large, or cumbersome. Books are, almost by definition, compact and portable. The design eliminates or severely curtails this portability (U.S Pat. No. 1,692,337, Forbes 1927; U.S. Pat. No. 3,514,066, Singleton et. al., 1970; U.S. Pat. No. 3,889,914, Torme, 1975; U.S. Pat. No. 3,894,709, Weir, 1975, U.S. Pat. No. 5,351,927, Howell, 1994).

b) It is meant for only one or a limited number of positions and locations such as reading in bed only (U.S. Pat. No. 1,692,337, Forbes 1927; U.S. Pat. No. 3,889,914, Totroe, 1975; U.S. Pat. No. 3,514,066, Singleton et. al., 1970).

c) It does not support the book in a wide variety of positions, such as sideways. Many people would like to be able to read comfortably while lying in bed on their sides, their head resting on a pillow (all cited patents).

d) The book stand is not detachable from the support arm or usable on its own. It is important to be able to change positions and locations easily. One reads in bed for a while, but then might like to continue reading the same book in an easy chair or at a table or on an airplane or train. The book stand makes no provision for easily adapting to these different locations (U.S. Pat. No. 1,692,337, Forbes 1927; U.S. Pat. No. 2,741,869, Aibel, 1956; U.S. Pat. No. 3,514,066, Singleton et. al., 1970; U.S. Pat. No. 3,889,914, Torme, 1975; U.S. Pat. No. 3,894,709, Weir, 1975).

e) The book stand is only a book stand and is not designed to be attached to a support arm. Thus, there is no provision for reading while prone and facing upward, such as one might like to do in bed (U.S. Pat. No. 3,198,475, Flahive, 1965; U.S. Pat. No. 5,393,029, Senko, 1995; U.S. Pat. No. 5,445,416, Zareck, 1995).

f) The design allows for prone-facing-upwards reading, but the stand has support legs that will interfere with bed linen and make it difficult to get out of bed or to move around while in bed (U.S. Pat. No. 2,156,225, O'Meara, 1939; U.S. Pat. No. 2,741,869, Aibel, 1956; U.S. Pat. No. 3,894,709, Weir, 1975).

g) There are inadequate means for holding the pages open, while allowing for turning pages. There may be no page retainers or clamps whatsoever (U.S. Pat. No. 3,198,475, Flahive, 1965). Or the page clamps are rudimentary and make little or no provision for clamping securely the necessary variation in number of pages clamped over the course of reading a book from beginning to end. This will vary from only one page to two to three inches worth of pages (U.S. Pat. No. 1,692,337, Forbes 1927; U.S. Pat. No. 2,741,869, Aibel, 1956; U.S. Pat. No. 3,514,066, Singleton et. al., 1970; U.S. Pat. No. 3,889,914, Torme, 1975; U.S. Pat. No. 3,894,709, Weir, 1975; U.S. Pat. No. 2,156,225, O'Meara, 1939). The method for turning pages is cumbersome and prone to difficulty (U.S. Pat. No. 1,692,337, Forbes 1927; U.S. Pat. No. 3,514,066, Singleton et. al., 1970; U.S. Pat. No. 3,894,709, Weir, 1975). The page retainers may force the left and right pages of the open book to angle in toward each other slightly, meaning the book will not be open flat, inhibiting easy viewing (U.S. Pat. No. 5,445,416, Zareck, 1995). The page retainers will not adequately hold pages while book is facing downwards (U.S. Pat. No. 3,198,475, Flahive, 1965; U.S. Pat. No. 5,393,029, Senko, 1995.) The page retaining system is adequate but overly complicated (U.S. Pat. No. 5,433,415 Samson et. al., 1995 has a complicated rack-and-pinion linkage and four separate adjustment arms.)

h) The page holding system will tend to obscure part of the printer matter (U.S. Pat. No. 3,514,066, Singleton et. al., 1970; U.S. Pat. No. 3,889,914, Totroe, 1975).

i) The stand will not easily accommodate the variety of common but hard-to-hold books. For example, a thick but otherwise compact paperback such as Michener's Alaska or Tolstoy's War and Peace will quickly make obvious the shortcomings of the means for book and page retention. This is due to either the lack of a means for clamping the spine or cover (U.S. Pat. No. 3,198,475, Flahive), or because of an inadequate, rudimentary, or awkward means of clamping the book spine or cover (U.S. Pat. No. 1,692,337, Forbes 1927), or because of the inadequacy of the page-clamping-and-turning mechanism as described previously, or because of having no means for adjusting the lateral spacing of the two page retainers (U.S. Pat. No. 5,445,416, Zareck, 1995).

j) Illumination of a downwards-facing book can be difficult with normal room lights. The stand does not provide or allow for the integral attachment of a book light for illumination at the viewing angles made possible (all except for U.S. Pat. No. 3,889,914, Totroe, 1975, which positions a light on the support arm rather than on the book holder itself.)

k) There is apparently no prior design which can, independently of an elaborate cantilevered support arm, support the open book on its side and at intermediate lateral angles for reading while lying on one's side in bed.

l) Finally, there is no book support system which addresses a foreseeable need: to support an electronic display device such as those today found on the smallest portable computers. Technology is rapidly approaching which is likely to substantially replace printed matter with electronic flat panel displays. There are already "electronic books" on the market. A truly versatile reading stand should allow a simple flat panel display to be easily attached and viewed in place of a book.

In sum, no single instance of the prior art solves all of the important design requirements: book and page retention, positioning, portability, versatility, illumination, and reasonable cost.

OBJECTS AND ADVANTAGES

The object of this invention, then, is to provide a book supporting system that will provide for the following:

1) The book stand will allow hands-free reading by supporting a book, open and with the pages firmly restrained no matter what position the book support may be placed in.

2) The book stand will provide a simple and dependable means for manually releasing, turning, and securely re-clamping the pages.

3) The book stand will support a range of sizes of books and other reading material from small paperbacks to large, thick, hardbound textbooks, as well as magazines, binders, notebooks, etc.

4) The book stand will support such reading material in a number of different positions, including at various angles on a table or desk, on a sideways tilt for reading on one's side in bed, and in various chairs, sofas and other seats.

5) The book stand will collapse quickly and easily so as to be portable and storable, either with or without reading material attached.

6) The book stand will provide a versatile mounting and positioning system that would allow it to attach quickly and easily to such additional support stands or brackets.

7) The book stand will attach and detach easily from an additional support stand. This additional stand would be adjustable in height and position, in order to make a number of other important reading positions available. These would include: on one's back or in other reclining positions in bed; at a desk with the book raised independently off the surface of the desk; and in an easy chair with the book suspended free of the chair and reader. In this way, the book stand, as a multi-part system, will accommodate virtually any desired combination of reading location, body position, and book angle, while still being detachable and portable.

8) The book stand will provide for the attachment of an integrated, portable source of light for adequate, convenient, and unobtrusive illumination of reading material.

9) The book stand would be low in cost to the consumer, being relatively simple and inexpensive to manufacture.

10) The book stand will be a fully-functional separate part of a component system. Since additional support stand and light unit mentioned above would be available as components, this would keep the cost of the basic book stand very affordable. This is an essential part of a product strategy further distinguishing this invention from previous patents and currently available products.

11) Finally, the bookstand would easily accommodate conceivable flat-panel electronic display devices, providing similar benefits of positionability and more comfortable reading or viewing positions.

LIST OF ILLUSTRATIONS

There are 13 separate drawing sheets. Some sheets have more than one distinct illustration on the same page, as denoted by lettered suffixes "A," "B," or "C".

7A and 7B show front and rear views of book stand supporting a book at an intermediate lateral angle, as for reading while lying on one's side in bed.

FIGS. 8A and 8B show book stand in a completely collapsed and portable configuration, front and real views.

Figure 9:
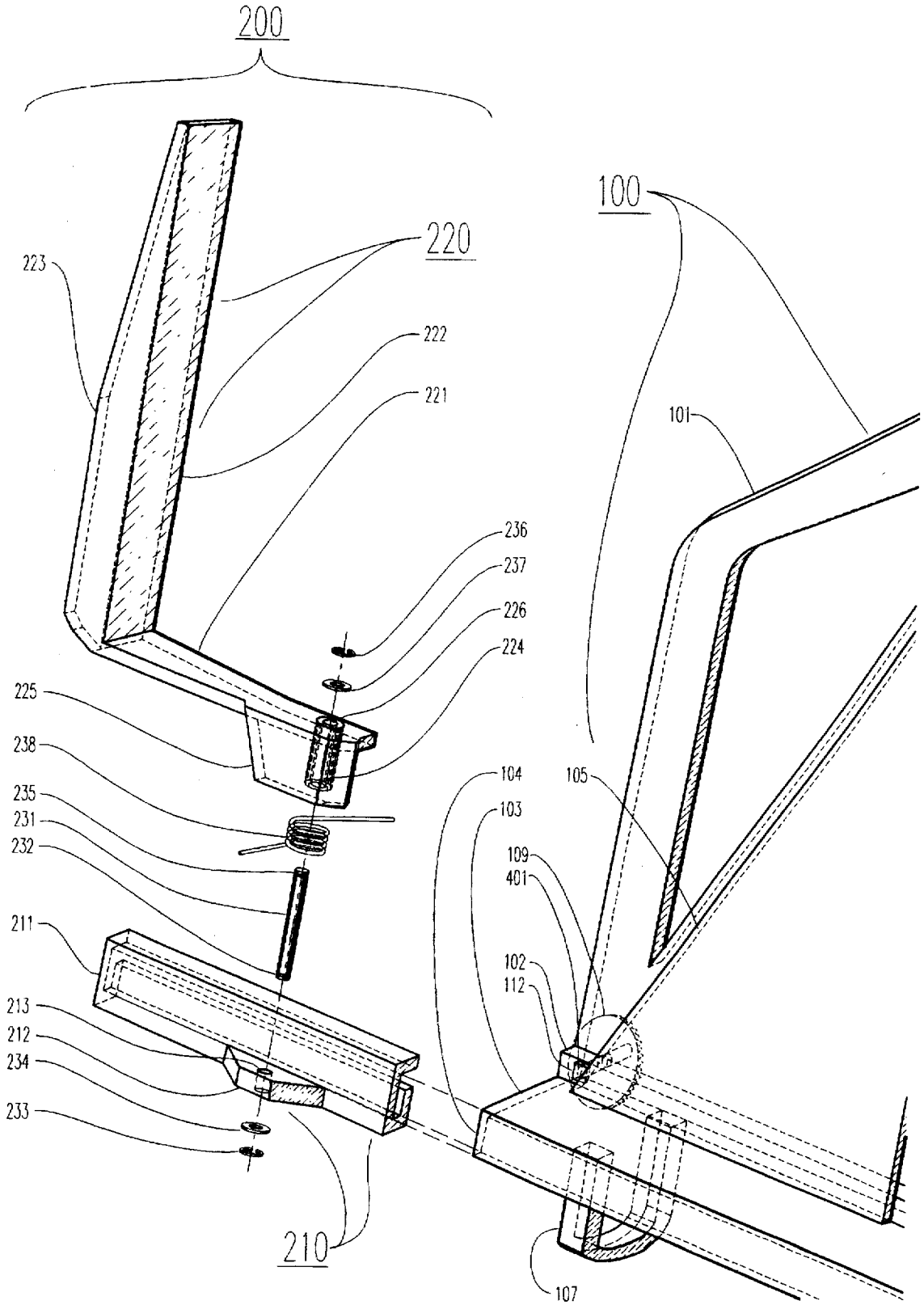

FIG. 9 is a frontal exploded view of sliding page clamp mechanism and sliding rail at bottom left-hand corner of book stand frame.

Figure 10:
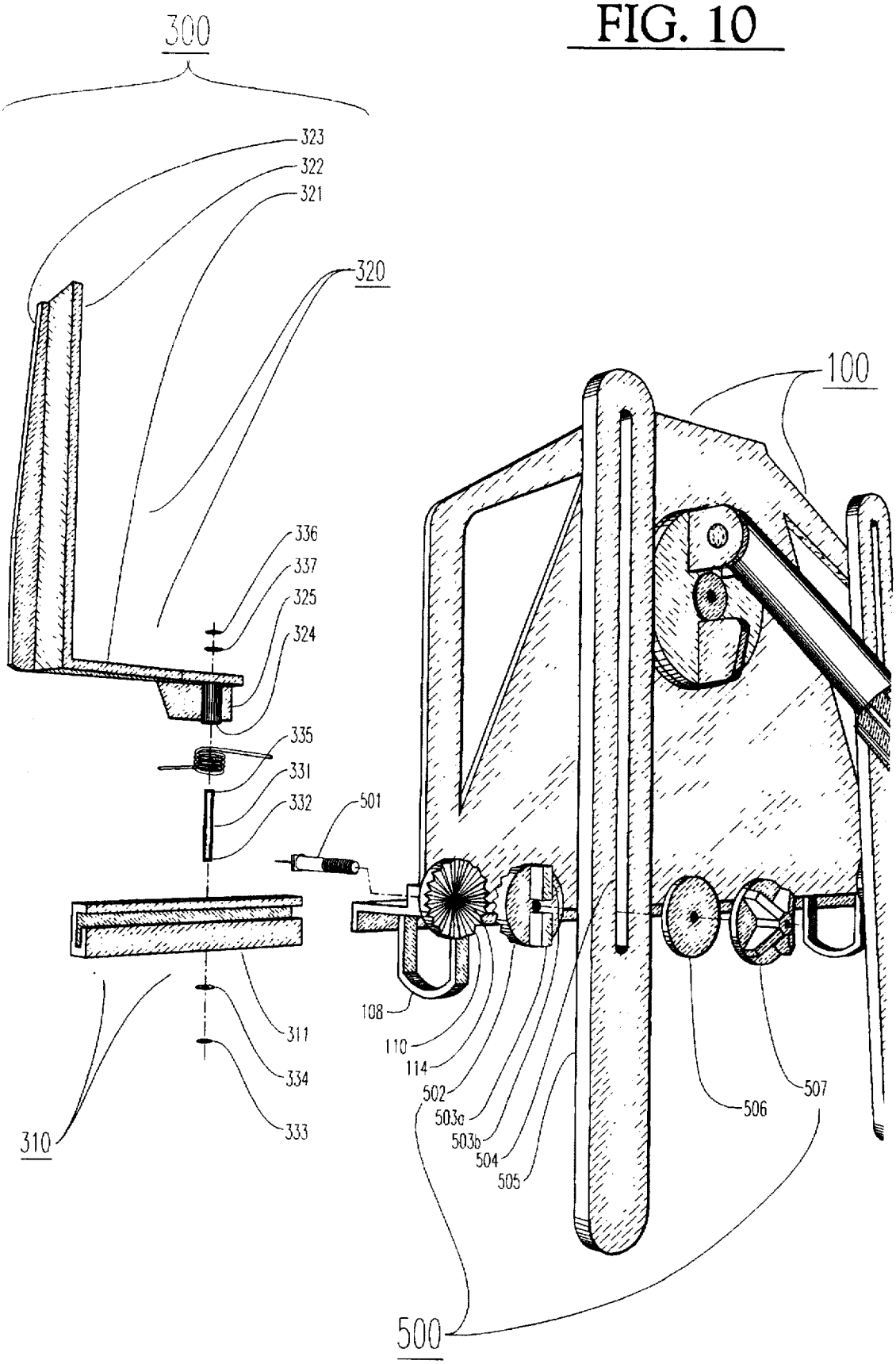

FIG. 10 is an exploded view of right-hand rear section of book stand, detailing parts of right-hand page clamp assembly, as well as an exploded view of right-hand support arm assembly.

Figure 11:
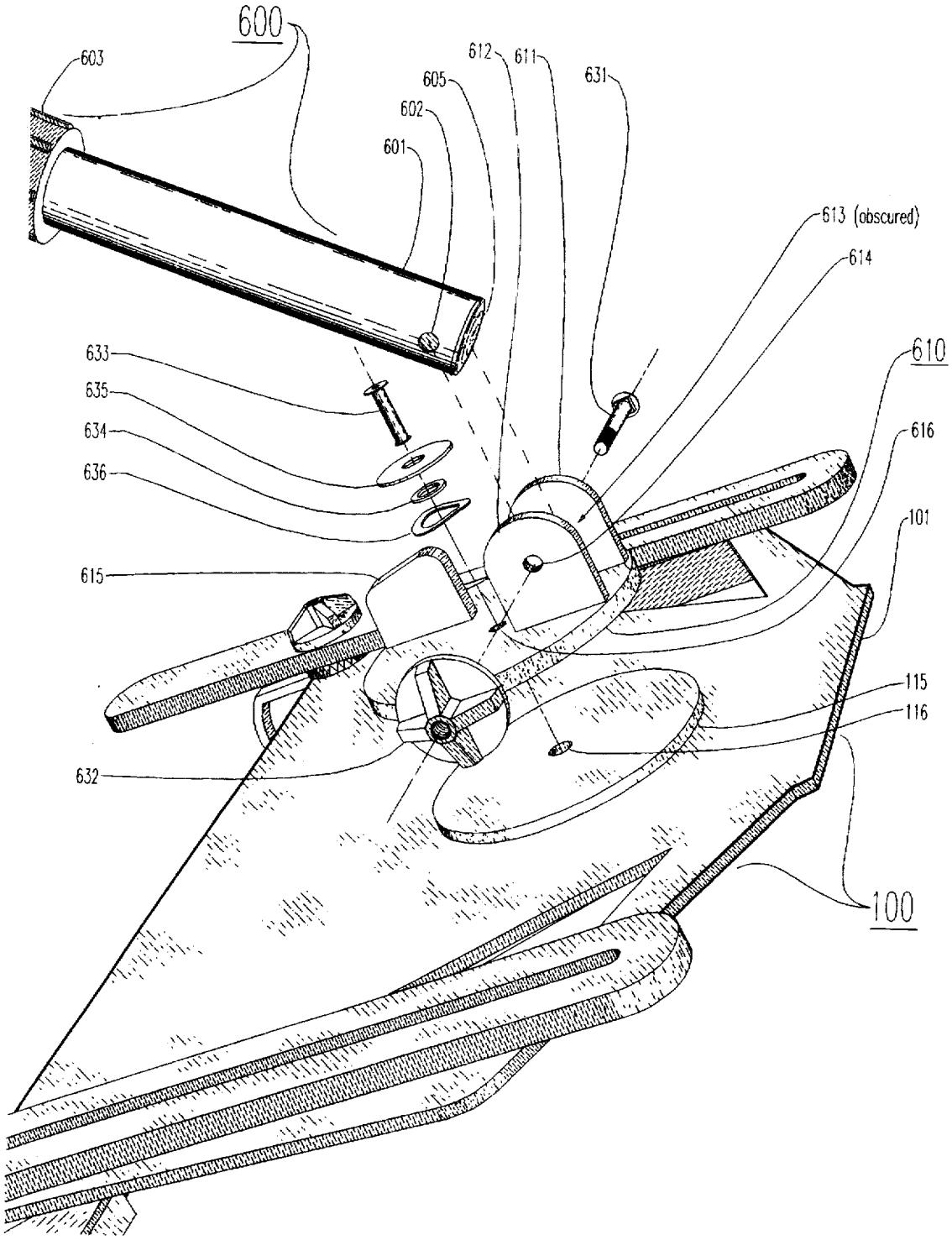

FIG. 11 is an exploded view of mounting of rotating and pivoting rear telescoping leg.

FIGS. 12A, 12B and 12C show different views and positions of book stand attached to an example of an auxiliary support stand.

Figure 13:
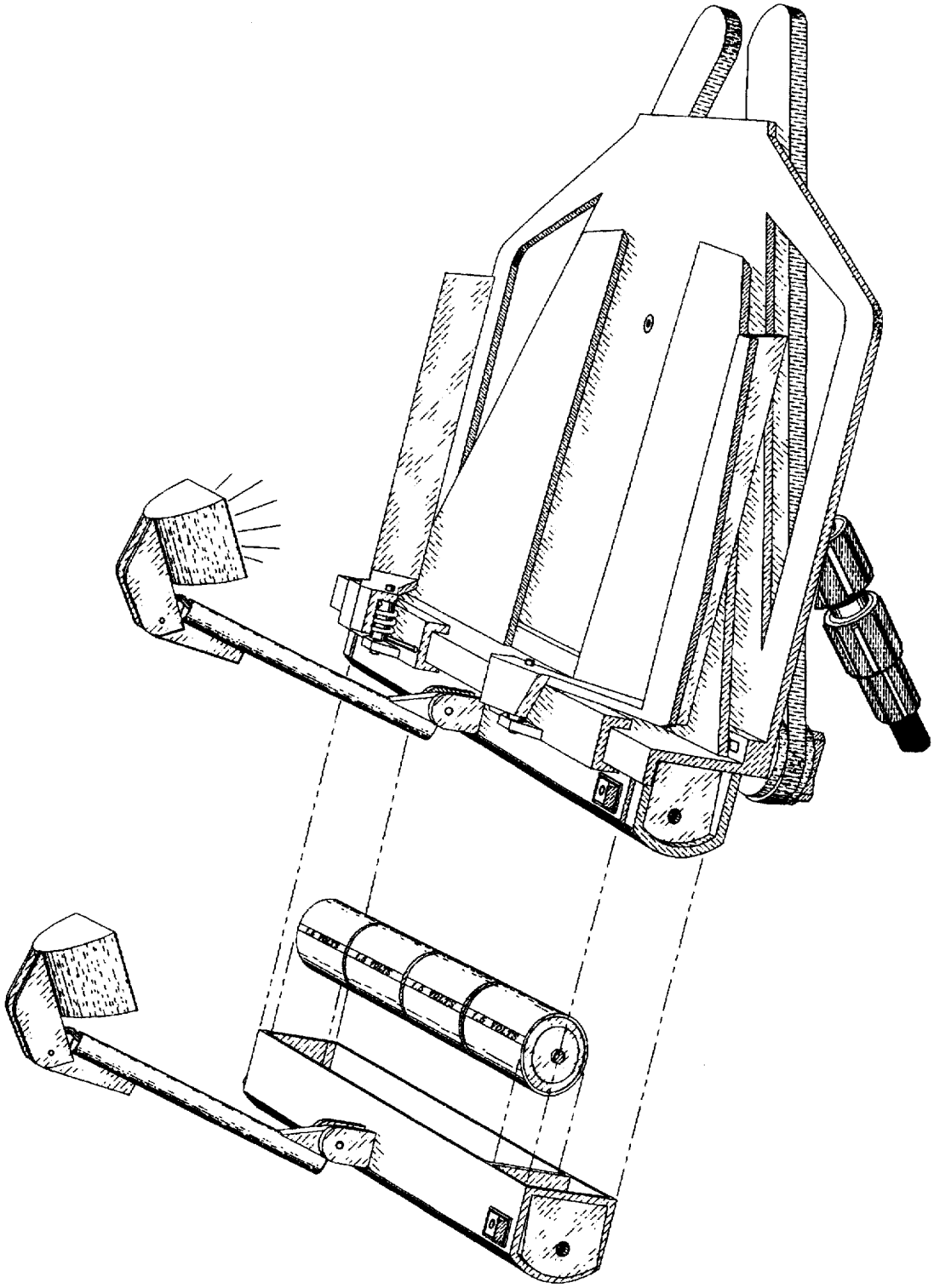

FIG. 13 shows one possible arrangement for adding an adjustable battery-powered light to bottom of book stand.

| List of Parts Reference Numerals | |
|---|---|
| 100 | book stand frame |
| 101 | backing plate |
| 102 | book ledge |
| 103 | lower ledge |
| 104 | slide rail |
| 105 | book cover clamp (left-hand) |
| 106 | book cover clamp (right-hand) |
| 107 | table support loop (l. h.) |
| 108 | table support loop (r. h.) |
| 109 | toothed disc (l. h.) |
| 110 | toothed disc (r. h.) |
| 114 | square-countersunk through-hole |
| 115 | reinforcement disc |
| 116 | rivet through-hole |
| 200 | page clamp assembly (left-hand) |
| 210 | slider unit |
| 211 | slider |
| 212 | pivot-pin mounting tab |
| 213 | pivot pin mounting hole |
| 220 | lever unit |

-continued

| List of Parts Reference Numerals | |
|---|---|
| 221 | extension arm |
| 222 | clamp bar |
| 223 | finger tab |
| 224 | pivot bearing |
| 225 | spring cover |
| 226 | bearing through-hole |
| 231 | pivot pin |
| 232 | lower ring groove |
| 233 | lower retaining ring |
| 234 | lower washer |
| 235 | upper ring groove |
| 236 | upper retaining ring |
| 237 | upper washer |
| 238 | torsion spring |
| 300 | page clamp assembly (right-hand) |
| 310 | slider unit |
| 311 | slider |
| 320 | lever unit |
| 321 | extension arm |
| 322 | clamp bar |
| 323 | finger tab |
| 324 | pivot bearing |
| 325 | spring cover |
| 331 | pivot pin |
| 332 | lower ring groove |
| 333 | lower retaining ring |
| 334 | lower washer |
| 335 | upper ring groove |
| 336 | upper retaining ring |
| 337 | upper washer |
| 338 | torsion spring |
| 400 | support arm assembly (l. h.) |
| 401 | square-headed screw |
| 404 | support arm |
| 407 | finger nut |
| 500 | support arm assembly (r. h.) |
| 501 | square-headed screw |
| 502 | toothed washer |
| 503a | slot tab |
| 503b | slot tab |
| 504 | support arm |
| 505 | slot |
| 506 | fender washer |
| 507 | finger nut |
| 600 | telescoping leg assembly |
| 601a | aluminum tube |
| 601b | aluminum tube |
| 601c | aluminum tube |
| 601d | aluminum tube |
| 602 | mounting hole |
| 603a | adjusting collar |
| 603b | adjusting collar |
| 603c | adjusting collar |
| 604 | rubber foot |
| 605 | end cap |
| 610 | rotation disc |
| 611 | mounting ear |
| 612 | mounting ear |
| 613 | square through-hole |
| 614 | round through-hole |
| 615 | rotation thumb tab |
| 616 | rotation hole |
| 631 | carriage bolt |
| 632 | finger nut |
| 633 | rivet |
| 634 | fender washer |
| 635 | spring spacer |
| 636 | wave spring washer |

SUMMARY OF INVENTION

Briefly, the invention consists of:

A book stand frame with two book cover clamps, designed to hold and support open books and other reading or display material of various sizes.

Left- and right-hand spring-loaded page clamps, which slide laterally on a rail affixed to bottom of book stand frame. These are intended to forcefully hold pages flat by pressing back against the outer margins of the page. They may be individually released for turning pages, and slide laterally to accommodate various sizes of books and other reading material.

Left- and right-hand support arms, which rotate and extend from mountings near lower backside corners of book stand frame. These widely adjustable arms serve to raise book stand frame off the surface of a table or off the arms of an armchair, and also to position book stand frame on a sideways tilt for reading while lying in bed.

A four-section telescoping leg assembly, mounted near the center of backside of book stand frame. A special mounting arrangement allows telescoping leg to rotate and to pivot in virtually any direction. This member works as the third leg of a support tripod along with left and right hand support arms, and additionally provides an adjustable mounting member for attachment of book stand frame to an auxiliary support stand.

The invention also refers to several important ramifications, examples of which are included in the illustrations:

An auxiliary support stand to which book stand may be attached. The example illustrated is a simple floor stand which is adjustable in height. It allows book stand to be supported clear of a chair or table top, and is useful for reading in bed, at various chairs and recliners, or at a desk where book is to be kept above desk surface. Book stand's special rear rotating pivot leg has been designed to integrate with a simple clamp on such an arm, so as to allow easy positioning of book at virtually any angle. Included in the illustrations is one of many possible designs.

A detachable book light unit which in the illustrated example snaps onto the bottom of book stand itself. This particular portable design includes an integral battery pack, a.c.-d.c. adapter jack, pivoting lamp arm and pivoting lamp head. The light unit is a single assembly, entirely independent of the book stand, and snaps on and off easily.

DESCRIPTION OF THE INVENTION

A typical embodiment of the invention is depicted in FIGS. 1 through 11.

In this section, an exact physical description of this embodiment will be made without detailed reference to function, except where deemed necessary to clarify the mechanics of an assembly.

Figure 1:
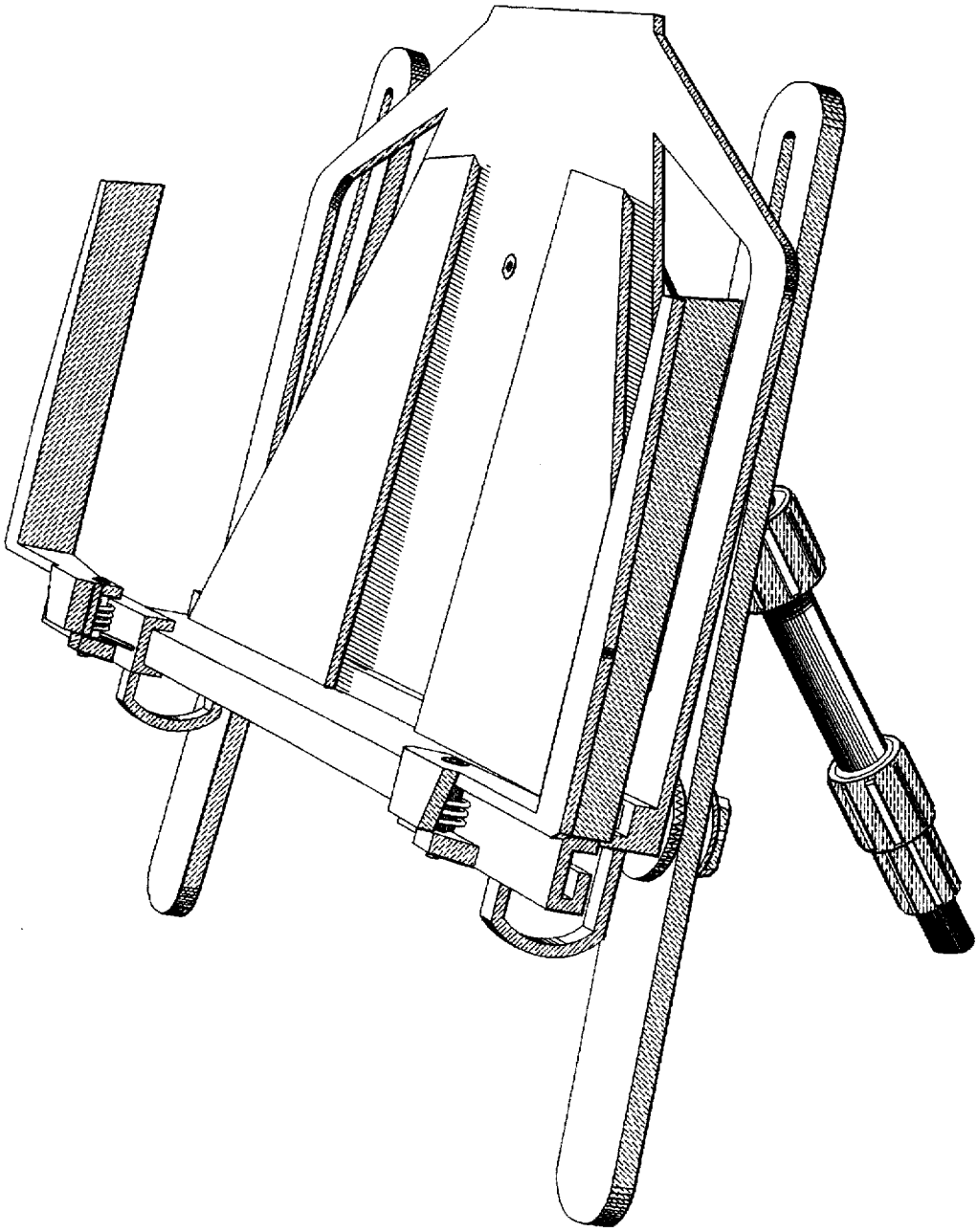
FIG. 1 shows a general frontal view from reader's side of complete book stand, with no reading material in place.

Throughout this description, the from of the embodiment will be taken to be that broad face as prominently visible in FIG. 1; left, right, bottom and top will be locational terms as would be construed from FIG. 1.

The word affixed will be used in reference to a part which is rigidly fused, cast, or formed as one solid piece along with other parts; it will be used when describing distinct sections of solid inseparable parts. The term attached will be used when referring to separately formed parts which are joined together by discrete fasteners or other mechanical means, and which parts may or may not move with respect to each other.

I. MATERIALS; STOCK ITEMS

The predominant material in this embodiment is molded ABS plastic. ABS is a common plastic from which many injection-molded parts and products are made. However, many alternate materials and construction processes could be used; this will be discussed fully in a subsequent section.

It will be assumed in this section that all parts of made of molded ABS plastic unless otherwise noted.

A number of standard hardware items, such as torsion springs, nuts, bolts, rivets, and washers, are metal items normally made of steel plated with cadmium, zinc, black phosphate, or some other protective surface treatment.

The telescoping leg is a ready-made assembly made of extruded aluminum alloy tube, nylon bushings and plastic screw-adjustment knobs. It also has a rubber friction-foot. In this instance, the telescoping leg pictured is a four-section telescoping leg found on a commonly available miniature consumer camera tripod.

II. BOOK STAND—FRONT

A. Book Stand Frame 100—Frontal Details

Figure 2:
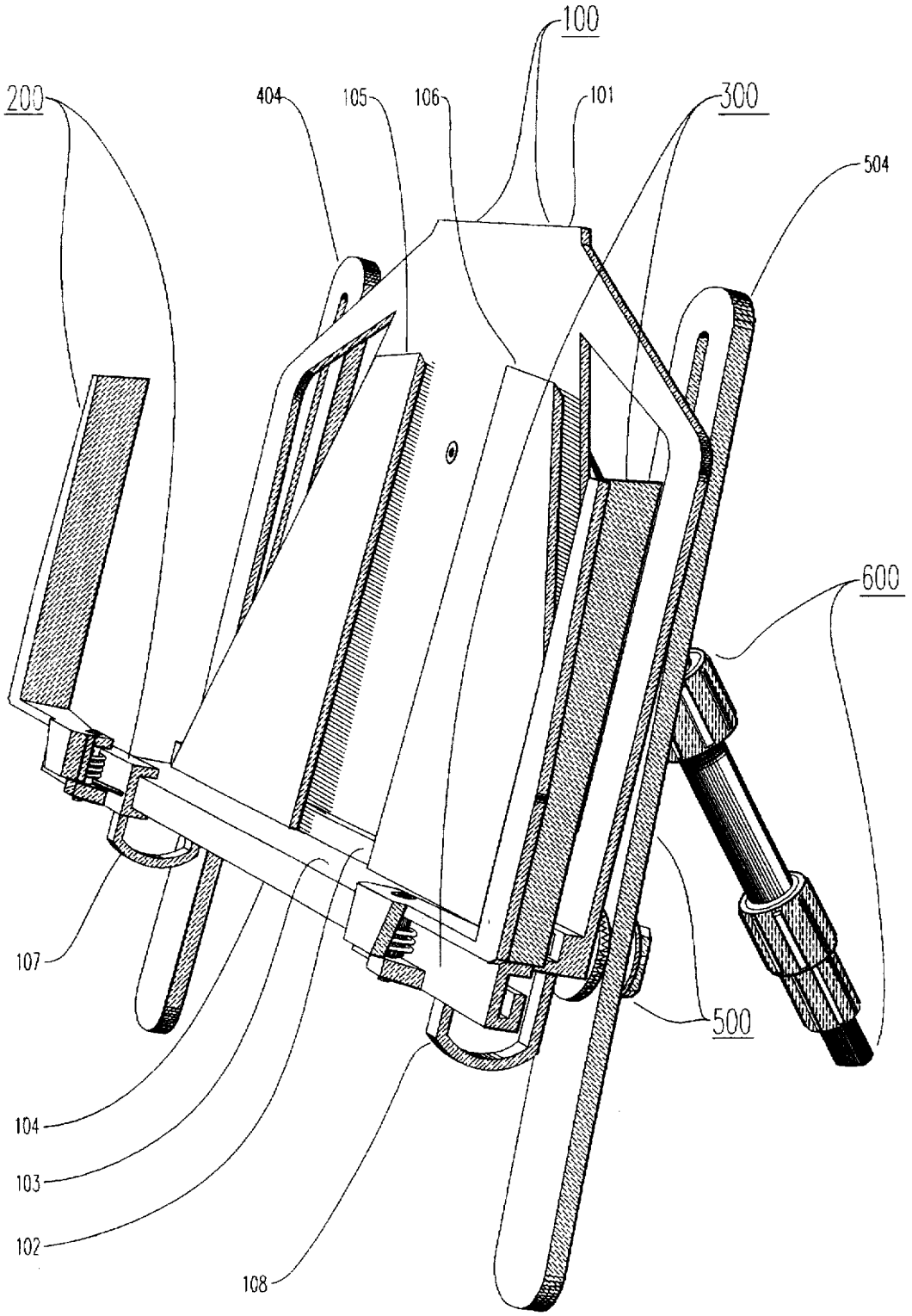
FIG. 2 is the same view as FIG. 1 but with parts reference numerals added.
Figure 4:
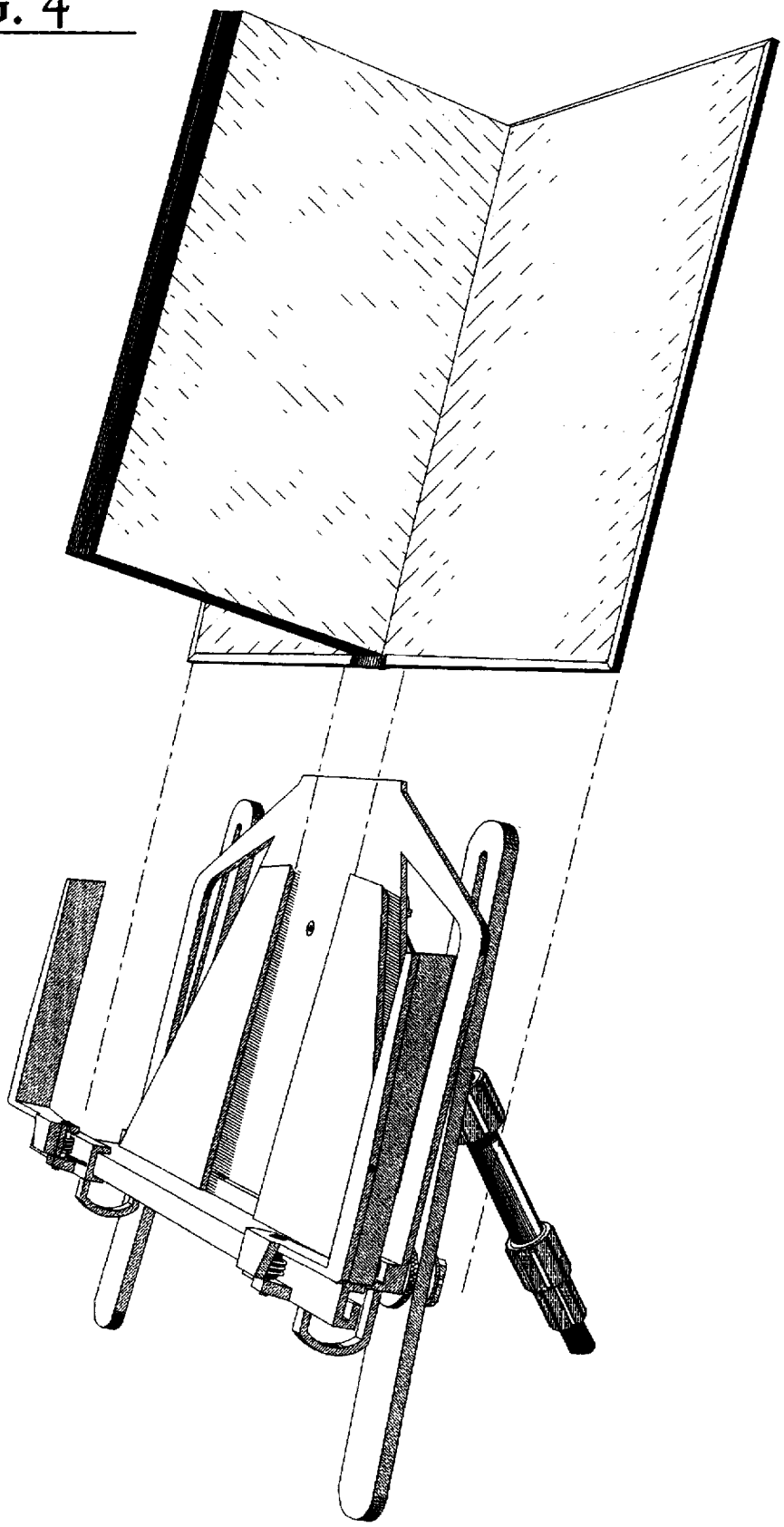
FIG. 4 shows an open book above stand, with projection lines indicating how book cover may be slid into position behind cover clamps.

Please refer to FIG. 2, showing a frontal view of book stand with parts reference numerals. For a frame of reference as to scale, please also refer to FIG. 4, showing an average-size hardbound book.

i. Backing Plate, Ledges, Slide Rail

Book stand uses as a foundation or chassis a solid complex which will be referred to as Book Stand Frame 100. The heart or central section of this frame is a backing plate 101, which in gross outline is a roughly rectangular, flat, rigid plate 300 mm wide and 3 mm thick. In silhouette, it has a solid trapezoidal center section, a straight bottom edge, and left and right handle- or elbow-like extensions forming roughly triangular cut-outs. Backing plate 101 is 200 mm high, somewhat smaller in dimension than that of an average hard-bound, open book.

Running the entire 300 mm length of bottom edge of backing plate 101 are a raised book ledge 102 which is 10 mm high and 6 mm thick, and, projecting forward at a right angle with backing plate 101, and just below it a broader lower ledge 103, which measures 35 mm across its top face and 3 mm in thickness. Off front edge of lower ledge 103, projecting downward at a right angle, is a 12 mm-wide squared lip or slide rail 104. It also runs entire 300 mm width of backingplate 101 and is 3 mm in cross-sectional thickness. These four sections (101, 102, 103, and 104) are not separate parts, but rather are integral sections, rigidly formed as one part of frame 100.

Other details relating to the back side of frame 100 are described in more depth in Section III. For now, let us continue looking at front side of book stand.

ii. Book Cover Clamps

Just in front of backing plate 101 trapezoid are two rigid panels or fingers of flat rigid material, the left and right book cover clamps 105 and 106. They have the appearance of upright, narrow, right triangles with the tops clipped off. These quadrilateral panels are affixed atop the left-center and right-center of lower ledge and thus close against the front face of book ledge 102. The top edges are not square-cut in section but rather are undercut by 45 degrees, resembling in this way the cutting edge of a wood chisel, with the "ground" edge facing toward backing plate 101.

Cover clamps 105 and 106 extend approximately three-quarters of the way up toward top edge of backing plate 101, being each 155 mm high, 105 mm wide at the bottom, 35 mm wide at the top, and 3 mm thick. The orientation plane of cover clamps 105 and 106 is not perfectly parallel with but rather inclined back slightly towards backing plate 101. Thus, with no book inserted, upper "chisel" edges of cover clamps 105 and 106 make contact with the face of backing plate 101.

Left and right cover clamps 105 and 106 are laterally equidistant from center of frame 100, and are separated at their closest edges by a space of 65 mm. These closest edges are parallel.

While it is technically possible to injection mold this entire structure as one piece of plastic, this would require a complicated and expensive "retracting slide" mold. More likely, cover clamps 105 and 106 are glued, bonded, solvent-welded, or ultrasonically welded to frame 100. Alternately, it may be more advantageous to mold frame 100 in two pieces, with book ledge 102, cover clamps 105 and 106, lower ledge 103, and rail 104 as one molded part. This structure would then be glued, ultrasonically welded, or otherwise permanently attached along the bottom edge of front face of backing plate 101.

iii. Table Support Loops

Solidly affixed to underside of lower ledge 103, near left- and right-hand sides, are left and right table support bops 107 and 108. When viewed from either side of book stand, these elements are U-shaped, and have rectangular cross sections measuring 13 mm by 3 mm.

Viewed from the side, this "U" shape measures 32 mm wide and 32 mm high. Loops 107 and 108 are spaced slightly behind and away from page clamp rail 104 (approx. 3.5 mm), just enough to allow for passage of page clamp sliders 211 and 311 to be described below.

B. Page Clamp Assemblies i. Overview

FIGS. 9 and 10 show front and rear exploded views of two laterally sliding clamps for retaining pages, page clamp assembly (left-hand) 200 and right page clamp assembly (righthand) 300. These two assemblies are identical but that they are mirrored left to right. The following description, then, will enumerate parts of left-hand page clamp 200 only. The construction of right-hand page clamp 300 may easily be construed from this. (The term "page clamp" henceforth refers to entire assembly.)

In overview, each page clamp consists of a laterally sliding carrier, slider unit 210, upon which pivots an L-shaped arm or lever, lever unit 220. These two main sections are joined via a steel axle or pivot pin 231, while a spring steel torsion spring 238 provides a bias force which tends to rotate lever unit 220 around pin 231 in relation to slider unit 210.

Page clamps are not rigidly fixed parts of frame 100, but rather are free to slide along lower rail 104 mentioned above. They may even be removed and set aside as fully separate units, by sliding them fully off ends of rail 104.

ii. Slider Unit 210 and Pivot Pin 231

Starting with slider unit 210, this consists of a slider 211 which is a long box-like shape with a "G"-shaped cross section or extrusion (when viewed from the end). Slider 211 is 85 mm long, 14 mm across the top surface, while its front face is 18 mm high. The corner angles of this "G" shape are square, and the section is sized and shaped to mate with the 3 mm thick rail 104 mentioned above. Any given wall thickness of slider 211 is 3 mm. Protruding 15 mm out from the lower front edge of slider 211 is a trapezoidal tab of 6 mm thick material, pivot-pin mounting tab 212. Tab is 30 mm wide where it connects to slider 211.

Into the face of this tab is formed a 4 mm dia. pivot pin mounting hole 213, a through-hole into which is inserted a 4 mm dia. by 32 mm long steel pivot pin 231. The fit between pivot pin and mounting hole is a tight press-fit, such that pin 231 does not tend to rotate, slide, or rock once mounted. Near each end of pin 231 is machined or formed a standard ring groove (lower ring groove 232 and upper ring groove 235). Grooves are sized to fit a standard retaining ring (lower retaining ring 233 and upper retaining ring 236) designed for a 4 mm shaft. Grooves 232 and 235 are spaced 28.5 mm apart. Two steel washers (lower washer 234 and upper washer 237) with a 4 mm i.d., 8 mm o.d. and 1 mm thickness are also used in the assembly, directly inboard of retaining rings 233 and 236 (complete assembly detailed below.)

iii. Lever Unit 220

Moving on to "L"-shaped lever unit 220, this consists of a horizontal extension arm 221 which is a flat, oblong, roughly rectangular bar, 70 mm long by 18 mm wide by 5 mm thick. On the outboard end of this arm is fixed a flat rectangular clamp bar 222 extending upward 115 mm at a right angle, also 18 mm wide by 5 mm thick. Affixed along the forward outboard edge of clamp bar 222 is another long flat tab or lip of material projecting out at a right angle, finger tab 223. Finger tab 223 tapers from being 10 mm wide along its lower half to being 3 mm wide at the top of clamp bar 222.

Two additional details form completed lever unit 220. At pivot end of extension arm 221, opposite clamp bar 222, protrudes a 15 mm long by 8 mm dia. cylindrical or barrel-shaped tube, pivot bearing 224. This bearing cylinder projects downward, that is, in the opposite direction from the projection of clamp bar 222 and is perpendicular to face of extension arm 221. Its center is located in the center of the 18 mm-wide face of extension arm 221 12 mm from its end. Through axial center of hearing 224 is a 4 mm dia. hearing through-hole 226, sized to slip-fit with 4 mm pin 231. Hole continues completely though top face of extension arm 221. The final embellishment on lever unit 220 is a small flap of material angling around in front of bearing 224, on front lower edge and corner of extension arm 221. This tab of material is called spring cover 225, and is 35 mm wide, 17 mm high, and 3 mm thick. The six above described parts (221 through 226) are all fixed parts of a single solid unit which is referred to as lever unit 220.

iv. Assembly

Assembly of the complete page clamp assembly (left-hand) 200 will now be detailed, still referring to FIGS. 9 and 10.

First, the lower end of pin 231 is pressed through hole 213 of slider unit 210, protruding through the bottom side 3 mm, just far enough to fit washer 234 onto pin inboard of groove 232. Ring 233 may then be clipped or installed into groove 232.

Figure 5:
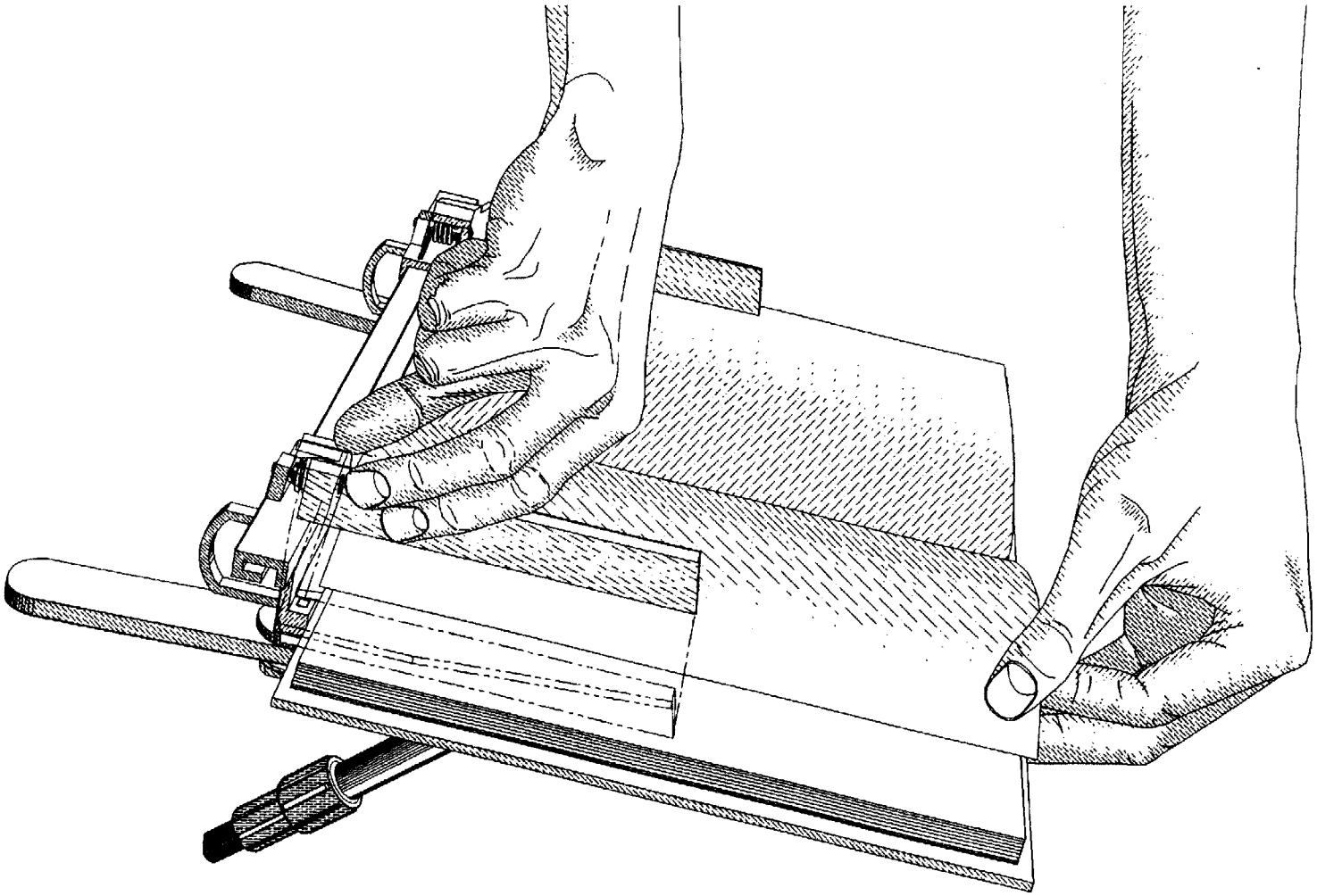
FIG. 5 is an illustration of how a page is turned showing two hands, one releasing right-hand page clamp and the other lifting a page.

Torsion spring 238 is shown in FIG. 5 in its open or relaxed position. This is a common spring of standard design, selected for appropriate coil diameter, end lengths, and spring force. In this instance, spring is made of spring steel wire 1 mm in dia. with four coils describing a cylinder of 10 mm inside diameter (uncompressed). The straight wire ends extend away from the coil 10 mm. For assembly, the protruding ends of spring wire must be rotated together, forcing spring into compression. To clarify: imagine grasping spring 238 in FIG. 9 by its coils with thumb and forefinger of the left hand. Then, with thumb and forefinger of the right hand, pull spring end wires to the right until they almost touch. Spring is now compressed. The compressed coil diameter is now about 9 mm. Spring force of such compressed spring is approximately 3 to 5 kilograms measured from ends of wire.

Compression of spring 238 being achieved, spring may be slid upwards so that its coils wrap around bearing 224 of lever unit 220. Lever unit 220 may now be dropped onto slider unit 210, such that previously attached pin 231 is guided through hole 226. Torsion spring now should be oriented so that its compressed ends are trapped between the right-hand side of face of slider 211 and backside, right-hand edge of spring cover 225.

Lever unit 220 should be pushed onto pin 231 far enough to allow for placement of washer 237 and installation of retaining ring 236 into groove 235. 28.5 mm spacing between ring grooves 232 and 235 is just enough to take up all slack between assembled parts without binding of pivot motion.

Page Clamp (left-hand) 200 is now complete. The force of spring 238 will tend to rotate lever unit 220 clockwise on slider unit 210, as seen from above. This rotation is limited or stopped by the left-hand edge of spring cover 225, which contacts the face of slider 211 when lever unit 220 rotates sufficiently. Lever unit 220 is thus prevented from rotating so far that spring tension is released.

v. Page Clamp Assembly (right hand) 300

As stated earlier, left and right page clamps 200 and 300 are identical but mirrored. Thus, construction and assembly of right-hand page clamp 300 is exactly analogous with the above description.

III. BOOK STAND—REAR

Attention may now be turned to the three main objects attached to back side of frame 100. Partially visible in FIGS. 1 and 2 are two flat bars with round ends protruding downward from the bottom of book stand, coming into contact with the horizontal table top. These are support arms 404 and 504. Also just visible, projecting down and to the right, is the third pole or leg of the "tripod". This third leg is Telescoping Leg Assembly 600.

Figure 3:
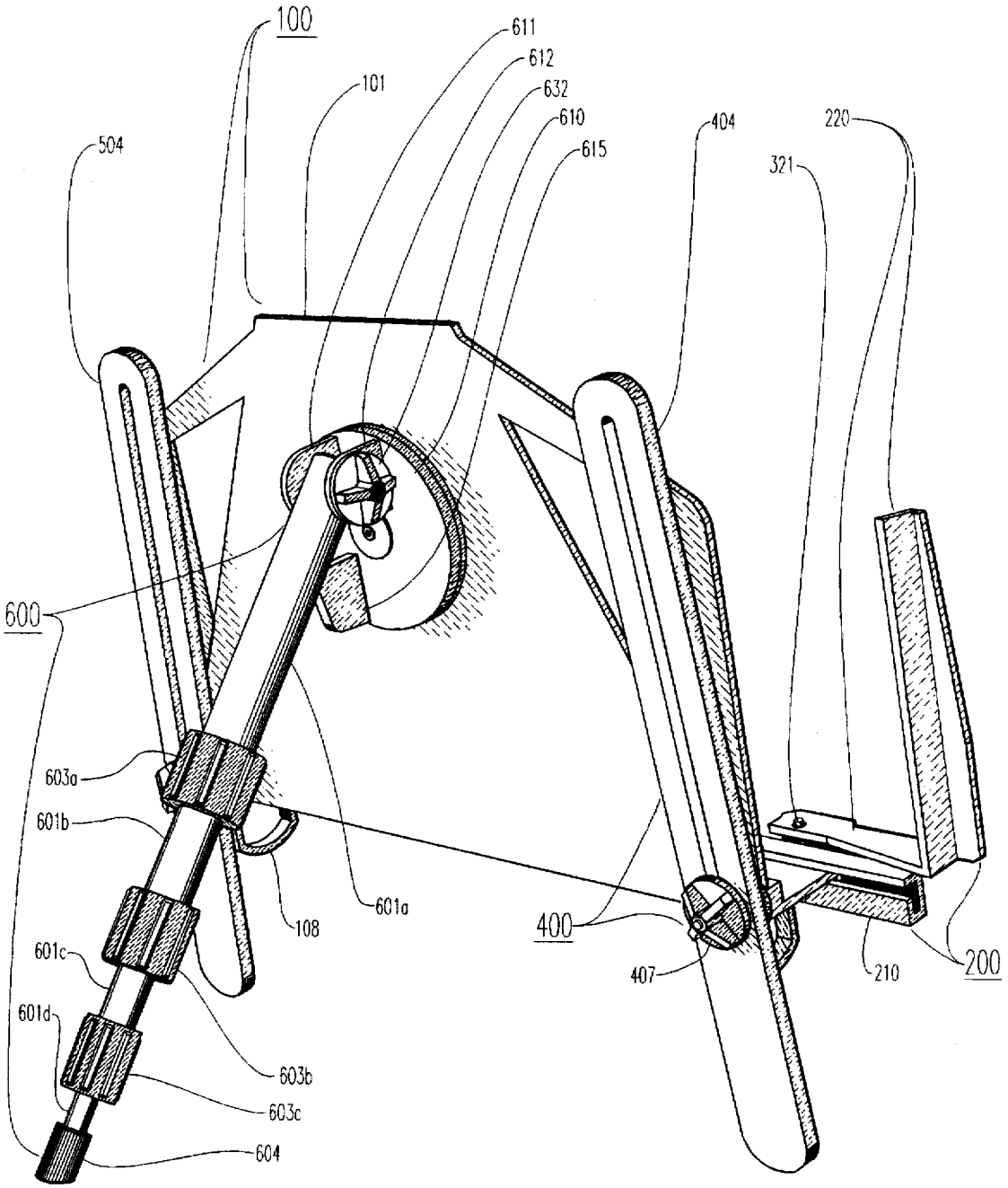
FIG. 3 shows a general view of stand positioned as in FIG. 1 but from the back side, with parts reference numerals.

Please now refer to FIG. 3. Seen from the rear, these three support members are now clearly visible. FIGS. 7B and 8B also gives a good general look at the back side of book stand, with such support members adjusted into alternative positions.

The following sections concern the configuration and mounting of these three support members.

A. Support Am Assemblies 400 and 500

Please now refer again to FIG. 10, the exploded view of right-side page clamp 300 and Support Arm Assembly 500. As with lee and right page clamp assemblies, lee and right support arm assemblies are identical but mirrored. Thus, in this description we will only describe right-hand support arm assembly shown in FIG. 10.

i. Support Arm and Toothed Positioning Discs

Arm 504 is an oblong flat bar of 280 mm length. The breadth of this bar is 30 mm, its thickness 5 mm. The two ends of support arm are rounded rather than square in outline, with a radius of 15 mm. An oblong perforation runs centered along the face of support arm, slot 505. This slot begins at 15 mm from one end of the arm and runs 180 mm down the center of the face. Slot is 5 mm wide, sufficiently wide to allow for free passage of the threaded shaft of a screw used to mount support arm to frame 100.

The mounting mechanism for each support arm consists of: square-headed screw 501 inserted into a matching square-countersunk through-hole 114 in front face of frame 100; a raised toothed disc 109 solidly affixed to rear face of frame 100; a toothed washer 502; a large steel fender washer 506, and a finger nut 507 which threads onto the end of screw 501.

To the left of the lower corner of flame 100 in FIG. 10 is shown screw 501.

This is a UNF 10-32 steel machine screw (American Unified National Fine thread) with a total length of 30 mm. Screw threads run the last 15 mm. The square head is 8 mm on each side and 3 mm thick. Hole 114 inflame 100 is 5 mm in diameter. Round hole is counter-relieved on the front face of frame 100 (this detail is not visible in FIG. 10). Counter-relief is 8.2 mm square and 3 mm deep. Thus, when square-headed screw 501 is seated into hole 114, it is flush with front face of book ledge 102. It protrudes 21 mm from rear of frame 100. Square head prevents screw 501 from turning when seated into square counter-relief of hole 114.

Solidly formed as an integral raised detail of back of frame 100 is a toothed disc 110. It may appear as if it were a separate disc or washer, placed onto rear of frame 100 over screw 501, however it is solidly affixed. This is a 30 mm dia. raised disc with, on its face, a circular array of raised ridges or teeth radiating out from hole for screw 501. There are 36 teeth in this particular pattern. It is centered over hole for screw 501

Just to the left of support arm in FIG. 10 is a toothed washer 502. Washer has a toothed pattern identical to that of toothed disc 110, and also has a 5 mm hole for passage of screw 501. Thus, when toothed washer 502 is slid onto screw 501, the faces of each part mesh completely, preventing rotation when snug. (This is very similar to the stacking of two checkers or poker chips one on top of the other, so that their ridges mesh.) On opposite face of toothed washer 502, facing support arm, are formed two box-shaped slot tabs **503*a* and 503*b*, each measuring 5 mm wide and 4 mm high. Tabs are centered and line up on center on either side of hole in toothed washer, and extend in length from hole to outside circumference of washer. Slot tabs 503*a* and 503*b* are sized to fit easily into slot 505 when support arm 504 is placed into position onto toothed washer 502. Thus, screw 501 protrudes through slot 505, allowing a common 30 mm dia. 1 mm thick steel fender washer 506** to be placed onto end of screw.

Finally, a finger nut 507, also having 10-32 UNF threads, can be screwed onto end of screw 501. Finger nut 507 consists of a 30 mm dia. disc with four raised radial ridges radiating from a central cylinder 10 mm high and 12 mm in diameter. The threaded central bore of cylinder is a brass or steel threaded insert, while the surrounding disc and finger-ridges are molded ABS. This is typical construction for commercially available finger screws. The radial ridges allow the screw to be easily tightened and loosened by hand without tools.

Screw 501 as specified is long enough for finger nut 507 to be loosened at least 3 mm without coming completely loose from screw 501. This 3 mm corresponds to the depth of the meshing teeth on toothed disc 110 and toothed washer 502.

Hopefully it may be seen that, when finger nut 507 is loosened only slightly, support arm 504 can be slid riding on its slot 505 radially along its length without it rotating on toothed disc 110. However, when loosened somewhat more (at least 3 mm), it may also be freely rotated around screw 501, slot tabs of toothed washer 502 still engaged into slot 505 but teeth of toothed washer 502 allowed to rotate clear of teeth on toothed disc. (This is more fully explained in a subsequent section.)

B. Telescoping Leg Assembly 600 and Mounting System

Telescoping leg 600 is fully visible (shown partially extended) in FIG. 3. It is shown fully collapsed in FIG. 8B. It is partially visible fully extended in FIG. 6. The mounting system of telescoping leg 600 is shown in exploded view in FIG. 11.

i. Four-section Telescoping Leg Assembly 600

This collapsible support member is, as mentioned previously, a stock item of a conventional design common to many previous supporting stands and devices. The most familiar of these would certainly be the camera tripod, where similar designs have been used in commercially-available products for at least thirty years. The design has also been used for lamp arms, photographic backdrop supports, projection screen stands, etc. The particular item used in this embodiment of the book stand is a four-section leg obtained from a disassembled camera tripod.

Since this is a stock assembly of known design, a fully detailed description will not be given here, though important functional elements will be described in sufficient detail to make its use with the present embodiment understood.

The general principle of the collapsing design is that of a friction-ring screw-collet, which will not be detailed here. Suffice it to say that, functionally, each two adjacent inner and outer sliding members are held in relative position and released at will by means of a manually-rotated screw collar mounted on the end of the larger member. An internal stop prevents the inner member from being fully withdrawn from its mate. Any two members may be released, adjusted for relative axial position, and made fast again by means of screw-collar.

Please refer now to FIGS. 3 and 11. In this embodiment, the telescoping leg consists of four sections of aluminum tube 601*a*, 601*b*, 601*c*, and 601*d*. Each section is of a smaller diameter than the previous, which allows them to nest one inside the other. There are thus three collet-locking adjusting collars 603*a*, 603*b*, and 603*c*; any two adjacent sections may be released and adjusted with respect to each other. The length of the entire assembly may therefore be adjusted from a fully collapsed length of somewhat longer than an individual section, to that of well over twice as long, and to any desired extension in between.

The overall length of fully collapsed telescoping leg 600 is 202 mm, measured from end cap 605 on its extreme upper end to its rubber foot 604. Its length fully extended is 470 mm. The outer diameter of largest aluminum tube 601*a* is 20 mm, the next 17 mm, the third 14 mm, that of the smallest 11 mm. There is a 5 mm dia. mounting hole 602 8 mm from the extreme end of tube 601*a*. Furthermore, the cross-section of each tube section is not perfectly circular; arranged opposite each other on the otherwise circular cross-section are two semi-circular indentations of 2 mm-depth; these features, being extruded down the entire length of each tube, serve as interlocks, preventing a tube section from rotating with respect to other sections when assembled, while still allowing sections to slide axially.

Adjusting collars 603*a*, 603*b*, and 603*c* are made of plastic and have molded-in ribs to facilitate manual grip. The internal (not visible in figures) collet, collet split-ring, and male threaded-insert are made of nylon. The lower end of smallest tube 601*d* has a heavy rubber foot 604 to prevent slippage and marring. The upper end of largest tube 601*a* has a plastic plug or end cap 605 with a 5 mm hole; cap 605 slides into the end of tube 601*a*, reinforcing mounting hole 602 and supporting tube 601*a* against collapse from compression of mounting screw.

ii. Mounting of Telescoping Leg Assembly 600

Please now refer to FIG. 11. This shows back side of frame 100 facing upwards, with the mounting parts exploded.

Starting with frame 100, please note a raised reinforcement disc 115 molded into back face of backing plate 101. It is 75 mm in diameter and 3 mm high. This disc is centered over a rivet through-hole 116 in the frame 5 mm in diameter. The center of this hole is positioned laterally in the center of frame 100 and 127 mm from bottom edge of frame (bottom edge is facing left in FIG. 11 .)

Shown above reinforcement disc 115 is rotation disc 610. It is similar in size to reinforcement disc 115, being also 75 mm in diameter, and has a thickness of 6 mm. Molded onto outer face of this disc are two mounting ears 611 and 612 and a rotation thumb tab 615. Ears 611 and 612 are each 30 mm high, 22 mm wide, and 5 mm thick. They are positioned parallel to each other 20 mm apart at their inner faces, just touching the outer edge of rotation disc 610. Rotation hole 616 is positioned through the center of disc face. Tab 615 is a 5 mm thick, roughly quadrilateral tab 20 mm high and 22 mm wide. It is not centered on disc, but is instead aligned with ear 611. This allows for clearance of telescoping leg 600 as it pivots on its mounting; mounted between ears 611 and 612, telescoping leg 600 can be "tilted" down nearly flush with the surface of backing plate 101 (as illustrated in FIG. 4*b*.)

Each mounting ear has a through-hole positioned 19mm up from the surface of rotation disc 610. On near ear 612, this is a round hole 5 mm in diameter (round through-hole 614.) On far ear 611, hole is 5 mm but is square (square though-hole 613, largely obscured in FIG. 11.) This allows for the seating of the square boss of the head of a UNF 10-32 carriage bolt 631 which is 38 mm long and made of plated steel. Aforementioned telescoping leg 600 is positioned between ears 611 and 612, and bolt 631 is pushed through square through-hole 613, mounting hole 602, and then round through-hole 614. Threaded end of carriage bolt 631 is then fitted with finger nut 632 which is identical to finger nut 507 described previously.

Finally, we come to the mounting of telescoping leg station disc 610 to frame 100 itself. Rotation disc 610 is positioned onto frame 100 with station hole 616 aligned with rivet through-hole 116. A spring-steel wave spring washer 636 is positioned over rivet through-hole 116. Wave spring washer 636 has a 24 mm o.d., 12 mm i.d., and is 1 mm thick when fully compressed and 4 mm high when uncompressed. It has a spring force of approx. 5 kg. when compressed flat. Inside the i.d. of wave spring washer 636 is placed a small cylindrical springspacer 635. It measures 10 mm o.d., 6 mm i.d., and 7.1 mm thick. Atop these two concentric parts is now placed a third overlaying steel fender washer 634 which has a 25 mm o.d., 5 mm i.d. and 1.7 mm thickness. A 5 mm dia. by 15 mm long rivet 633 is then inserted into the aligned holes of these assembled parts, and its end flared using a rivet punch-and-die until tight; that is, until fender washer 634 bottoms against spring spacer 635, which in turn bottoms against rotation disc 610. This serves to compress wave spring washer 636 to precisely 1.1 mm, but prevents force of rivet-setting tool from overcompressing parts. (When assembling it may be advantageous to compress assembly under a clamp before installing rivet.)

When properly assembled in this manner, a controlled amount of friction force (approx. 5 kg.) will be applied between contact faces of rotation disc 610 and reinforcement disc 115 by virtue of wave spring washer 636. This friction force serves to hold telescoping leg 600 in position relative to frame 100, while still allowing for relatively easy manual rotation to different positions when desired. Due to wave spring washer 636, eventual wear of the assembly has little effect on the amount of spring force applied. This spring pre-load arrangement is a fairly standard method for maintaining a constant amount of friction in rotating assemblies.

Three independent types of positioning of telescoping leg 600 can now hopefully be understood. It should be evident that leg can be adjusted for length, tilted, and rotated. To clarify: the mounting system allows for angular positioning of the leg in two ways. We may adopt the convention of calling the first positioning tilt, that is, angular position with respect to the plane of backing plate 101, using carriage bolt 631 as the axis. The second positioning may be referred to as rotation, which would be the angular position altered by twisting the entire telescoping leg 600 along with rotation disc 610 using rivet 633 as the axis.

This concludes the physical description of this embodiment of the invention. We shall now turn to a discussion of the functional operation of this embodiment.

OPERATION OF INVENTION—MAIN EMBODIMENT

The previous section detailed four basic elements of an embodiment of the invention. Here is a recap, adding a brief description of the functional purposes of these elements.

Book stand frame serves as a structural basis holding all the parts together. It provides a rigid backing plate against which is pressed an open book or other reading material, and to which the three support members are attached; integral cover clamps as a means for holding an open book by its two covers; and a lower slide rail which holds and guides two page clamp assemblies.

Two page clamp assemblies, mounted on the lower slide rail, slide laterally to accommodate books of various sizes, and have pivoting, sprung L-shaped arms which serve to press the pages back against the open book covers, without obscuring any text.

Two adjustable support arms, mounted at the two lower lateral back corners of book stand frame, assist book stand to be elevated off a table, perched on the arms of an arm chair, and titled on its side for bedside reading.

A telescoping leg assembly, by virtue of its tilt-and-rotation mounting system and friction devices, is the versatile third leg of the tripodal support system. This leg and its mounting system also serve as an advantageous "handle" for joining book stand to various conceivable additional support arms and stands, allowing the book and stand to be positioned in virtually any spatial orientation, including face-down.

The following paragraphs will elaborate on the exact manner in which the previously described embodiment of the invention may be operated.

A. Table-top Position

Before actually inserting a book, one may set book stand up in one of its most basic useful positions. This may be called the table-top position (a variation of which is shown in FIG. 1 ,) useful for reading while sitting at a desk or table. This will also enable one to become familiar with the function and adjustments of the three support members.

In the simplest instance, book stand will rest on a tripod consisting of table support loops 107 and 108, and rubber foot 604 (on the end of telescoping leg 600). Support arms 404 and 504 are fully retractable behind frame 100 (see FIG. 8*b* and FIG. 13) and are not necessary for this simplest table top position. Telescoping leg 600 is "tilted" at a position approximately 45 degrees from parallel with backing plate 101. Leg "rotation" on rotation disc 610 should be zero-in other words, pointing down perpendicular to the lower edge of backing plate (using the terms "tilt" and "rotation" as set forth on p. 17.) Book stand may now be placed upright on table surface.

FIG. 1 shows a useful variation of the above position, in that support arms 404 and 504 have been extended approximately 75 mm below table support loops 107 and 108, and telescoping leg 600 has likewise been lengthened a similar amount. This serves to raise the book to elevations above the desk or table top, which for numerous reasons may be a more desirable book-viewing position.

To alter the position of a support arm 404 or 504 is a simple matter. It may be helpful to hold book stand with its front face pointing down or resting face-down on table top. Referring to parts enumerated in FIG. 10: to loosen mounting of support arm 504, finger nut 507 is turned counterclockwise, about two to three turns. This is sufficient to allow ridges of toothed washer 502 to float freely away from ridges of toothed disc 110. Support arm 504 may now be freely rotated about axis screw 501, and may also be slid lengthwise with slot tabs 503*a* and 530*b* engaged in slot 505. In this way any combination of rotation in relation to frame 100, as well as length (limited by length of slot 505) may be attained. When desired position is attained, finger nut 507 may be re-tightened. It is only necessary to tighten finger nut 507 sufficiently to prevent the slippage or rotation of support arm 504. It will be quickly learned with continued use how much tightening force is needed.

In FIG. 1 support am are splayed out slightly (to approximately 15 degrees from perpendicular to table top), which enhances the stability of book stand slightly. Because of the interlocking of toothed disc 110 and toothed washer 502 (FIG. 10), and the interlocking of slot tabs 503*a* and 503*b* and slot 505, support arm 504 when screwed down snug is quite resistant to any rotational motion. Due to simple friction between finger nut and fender washer, any longitudinal sliding can be prevented.

Once a desired angular position is achieved, a right loosening of finger nut will allow longitudinal adjustment of a support arm to be made without altering angular position, since interlocking teeth of toothed disc and toothed washer will still be partially engaged.

Note that slot 505 does not run the entire length of support arm 504, but stops approximately 110 mm short of one end. This facilitates equal adjustment of both arms to a minimally-raised position shown in FIG. 1. The un-slotted ends of support arms are positioned downwards so that ends of slots rest against slot tabs, thus providing a "hard" stop and insuring that both arms are extended the same length. Of course, if a lower height above the table is desired, arms may be rotated 180 degrees, allowing their effective length to be adjusted down to zero.

Telescoping leg 600 is also shown partially extended in FIG. 1. A partial extension is achieved by lengthening any one of the three extension tubes. This has been achieved in FIG. 1 by grasping upper adjusting collar 603*a* and rotating it counter-clockwise one half turn as seen facing rear of book stand. Lower sections of telescoping leg 600 may then be pulled out slightly and held in the desired position while adjusting collar 603*a* is rotated back tight. Lightly hand-tight is all that is needed for telescoping leg 600 to hold its position.

When all three support members (support arm 404 and 504 and telescoping leg 600) are adjusted and re-tightened, book stand may be replaced upright as a "tripod" on horizontal surface.

The various configuration and positioning options of these three support members, it will be seen later, enable book stand to be positioned in many different and useful positions. Before going into this, however, let us look at how a book is held in place in book stand, and the operation of page clamps.

B. Inserting a Book or Other Reading Material

FIG. 4 shows a hard-bound book being lowered into book stand, which is positioned on a table top in a slightly elevated position. (Please now refer also to FIG. 2 for parts references.) Page clamps 200 and 300 have been slid outward to allow book to be inserted more easily. Perhaps the easiest way to insert a book is to grasp all pages together in one hand, allowing covers to flap back away from pages. Then one cover at a time can be slid down slightly between cover clamps 105 and 106 and backing plate 101. Beveled edges at tops of cover clamps 105 and 106 facilitate inserting cover down between the two surfaces. Once both covers are partially inserted, book can be pushed down all the way until bottom edges of book covers rest on book ledge 102.

This raised ledge serves to space a book's pages up slightly, providing necessary clearance above page clamp assemblies' sliders 211 and 311 and extension arms 221 and 321.

Since cover clamps 105 and 106 are biased slightly back towards backing plate 101, cover clamps tend to press back against book covers slightly, providing resistance to any shifting of book's position. Book is now securely held in flame 100.

C. Slicing Page Clamps Into Position

Still referring to FIG. 2 for parts identification: with book now in position, left and right page clamps 200 and 300 can be slid inwards along slide rail 104. The object, of course, is to fix book's pages open to the desired page. Page clamps 200 and 300 are moved in just enough for clamp bars 222 and 322 to press down against the outside lateral margins of left and right pages of open book. Books and other reading material of virtually any common size may be fitted and pages restrained with this arrangement.

There is nothing preventing page clamps 200 and 300 from being slid completely off rail 104. They are completely independent and separable. When in use, however, spring force of page clamps 200 and 300 keep them quite securely in place. Even with no reading material in place, page clamps may be kept securely attached to book stand frame 100 by sliding them inwards until clamp bars 222 and 322 contact partially or entirely against front face of backing plate 101 or cover clamps 105 and 106.

FIG. 5 shows the manual opening of right-hand page clamp 300. The thumb of the right hand pushes against the inside corner of spring cover 225, while the fingers pull on the outside edge of finger tab 323. While grasping or restraining remainder of book stand with the opposite hand, page clamp 300 can now be freely slid into position over desired page of reading material. The assembly should be positioned so that clamp bar contacts page just outside the printed area along the outside lateral margin of the paper. In this way the special shape and configuration of the page clamps allow the pages to be firmly restrained across a long section of the page without obstructing in any way the view of the printed area.

We shall now examine in some detail why it is so important that the lateral positions of page clamp assemblies be quickly and easily adjustable at all times. The lateral position to which a page clamp is moved depends not only upon the size of the book, but also upon the location of the particular page to be read. Towards the first pages of a book, both page clamps will be positioned off-center somewhat to the left. Towards the final pages of a book, the clamps will have to be moved somewhat to the right, depending on the thickness of the book. This is because each successive page of a book is bound to the spine in a slightly different lateral position. The pages are bound up tightly together, but since even the thinnest paper has some thickness to it, each page is moved over slightly from its predecessor by exactly one page thickness. We examine this obvious phenomenon in detail because it means, for our purposes, that the positions of the page clamp assemblies will have to be shifted slightly at regular intervals during the course of normal page-by-page reading. This is necessary to keep page clamp bars 222 and 322 in the desirable position between the edge of the page and the margin of the printed area. Depending on the thickness of the paper and the width of the margins, this may be necessary as often as once every fifteen or twenty pages, or as seldom as every fifty pages or more.

Hopefully now it is obvious why the design of page clamps allows for this lateral adjustment to be carried out so quickly and easily. The spring clamping action not only holds the page in place—it also holds clamp assembly itself in position on flame 100. When a page is released for turning, it is at the same time possible to shift position of a page clamp over slightly. There is no need to loosen or re-tighten any other screw or clamp; with some practice, this simple procedure becomes almost unconsciously achieved.

D. Turning Pages

The operation of page clamps 200 and 300 in the normal course of reading should now be fairly apparent. When it is desired to turn a page, reader simply grasps right-hand page clamp's finger tab 323 as shown in FIG. 5 and lifts very slightly. With the other hand, reader pulls one page free of the stack and lifts page corner away from book and upward slightly. Right-hand clamp 300 is now released. Page is flipped over to the left with the right hand, and the left hand now grasps and releases left-hand clamp 200 in a manner similar to that of a right-hand unit just described. Edge of the page is tucked under now-raised clamp bar 222 using the right hand. This being achieved, left-hand clamp 200 may also be released. This completes a typical turn of a page.

If reader, after turning a number of pages, notices that printed material is beginning to be obstructed by left-hand clamp bar 222, or that right-hand clamp bar 322 is starting to fall of the edge of the right-hand stack of pages, page clamp or clamps may be released slightly and moved over to remedy the problem, either in the course of turning a page, or at any other time.

The above described method is not the only conceivable way to operate page clamps. There are various other ways to position the fingers and hands, for instance. Also, it is not really necessary to release right hand clamp 300 in order to release a page (it will generally just slide up and out when pulled.) It is even possible with some dexterity and practice to insert a book, position page clamps, and turn pages with only one hand.

E. Holding Power

With book in place using cover clamps 105 and 106, and page clamps 200 and 300 properly positioned over pages, book stand may now be moved around and positioned in almost any spatial orientation. Book stand may be held with the open book facing directly downwards. It may even be shaken up an down to some extent without any pages coming loose. Book stand may in most cases even be held upside down without book sliding out of book stand. (Violent motions, and very large or heavy books may of course prove the exception to these cases.)

F. Variations in Reading Material

Book stand as here embodied is sized to accommodate the most common sizes of popular books, novels, textbooks, magazines, pamphlets, binders, hard and soft bound books, etc. This range is achieved without making the aggregate stand terribly large, as is the case with most other designs aiming for similar functional capabilities. There is no limit as to the height of reading material. In width, a book may be so large as to extend well beyond edges of book stand frame 100.

It may be helpful now to refer again to FIG. 2. Assume that page clamps 200 and 300 have been slid out to their maximum practical separation, maintaining a minimum of 20 mm of engagement between sliders 211 and 311 and rail 104. Page clamps' clamp bars 222 and 322 will now be separated by distance of approximately 410 mm.

The minimum width when slid together is approximately 170 mm. If a book or other display object is extremely narrow, the two page clamps may be reversed left for right. This will enable the separation between clamp bars 222 and 322 to be reduced virtually to zero. In this way, book stand may be used with even the narrowest of reading material.

Clamp bars 222 and 322 open to a maximum distance of approx. 90 mm from face of cover clamps 105 and 106. While an exception may always be found, this is more than adequate for even the largest college textbook; a typical hardbound collegiate English dictionary is approximated 70 mm thick including covers, and approx. 300 mm wide between open covers.

For paperback books (especially very thick but otherwise compact ones such as best-seller novels) it may be found that cover clamps 105 and 106 do not firmly grab the thin paper covers as is the case with hardbacks. However, once the page clamps are moved into place, the added spring force will be found to be more than sufficient to hold the book and the pages in place on book stand.

For magazines, it is not really important for the cover clamps to be used at all. Most standard format magazines will fit comfortably with page clamps pressing against page margins on the outer lateral edges of backing plate 101.

The general operation of the book stand should now be apparent. Thus far, we have seen how the stand is set up in a generic table-top position; how a book may be inserted and opened to a desired page; how the page clamp assemblies are moved into position, positively and unobtrusively restraining the pages open; how pages are released, turned, and again restrained; and how book stand will easily accommodate the majority of commonly read book sizes.

These functions alone, we believe, make the present book stand a useful and uniquely practical device, hitherto unavailable for this extremely common purpose: the act of reading at a desk or table. The hands are now largely free, to make notes on reading, to drink a cup of coffee, to eat, talk on the telephone, etc. The reader may now arise from reading and not have to search for a bookmark or worry about the book in any way. Cooking while taking directions from a cookbook; referring to repair manuals while working with greasy hands; referring to textbooks while typing a paper; these are some of the many common uses to which this stand may be put. However, up on a table top is not the only position this book stand lends itself to. We will now examine how the parts and mechanisms of the book stand described above serve to make it an even more versatile and useful reading-positioning device.

G. Using the Book Stand for Reading in an Armchair

Figure 6:
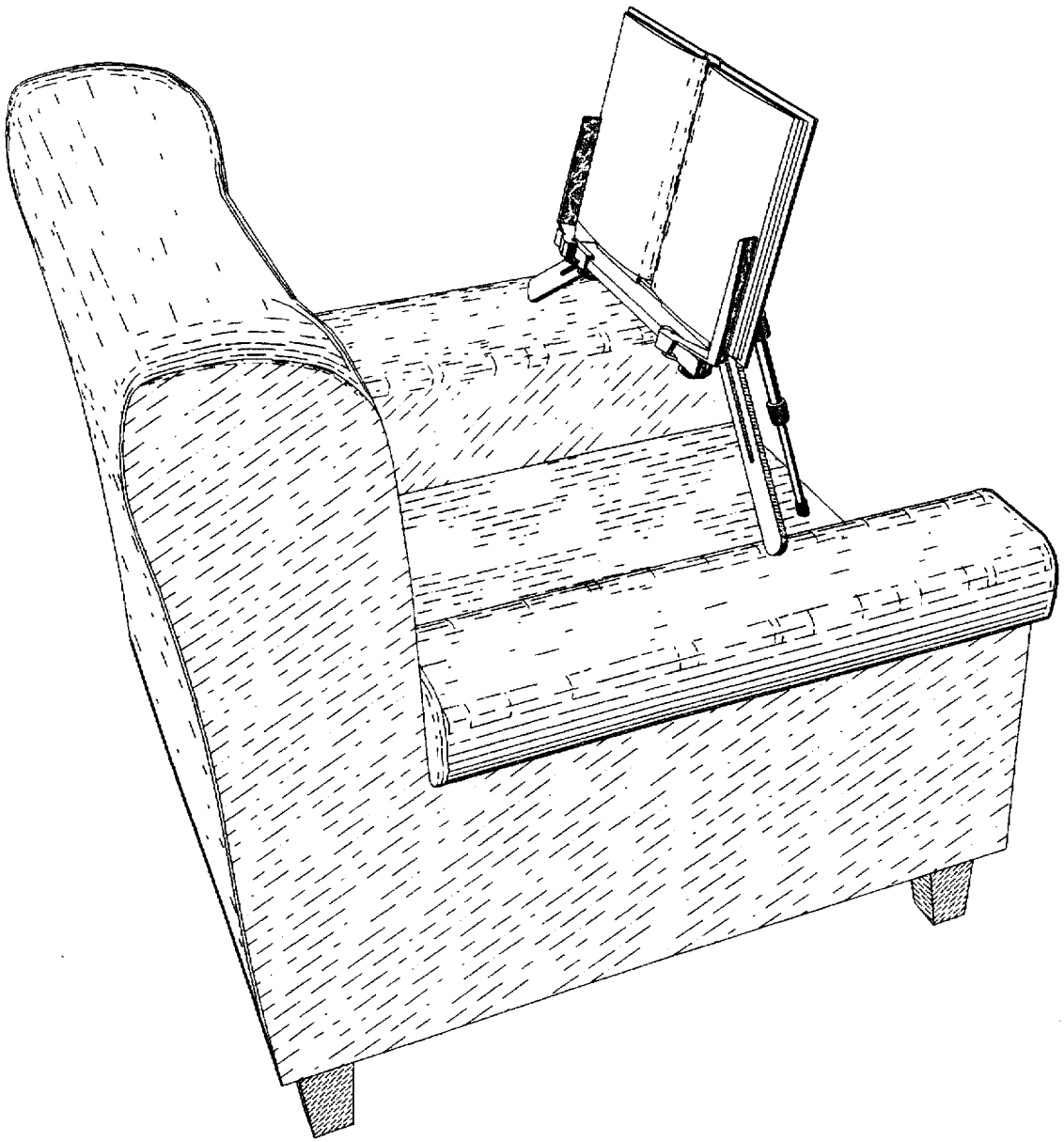
FIG. 6 shows how book stand's three support members can be adjusted to allow hands-free reading at an easy chair, without using an auxiliary floor stand.

FIG. 6 shows the book stand in position on an armchair of a fairly common "over-stuffed" design. This kind of chair is characterized in part by a broad, cushioned seat, broad, low arms, and a slightly reclined back. This style of chair is widely used for relaxing in domestic and informal environments, and is often a favorite place to relax with a book or other reading material.

It should be obvious from FIG. 6 that the book stand is little altered for this purpose; it is only necessary to release finger nuts 407 and 507, and then to rotate the lateral support arms and extend them to extreme positions pointing below and splayed outwards some degree from the vertical. The arms may be locked in place when the separation corresponds to that of the armchair's arms. Telescoping leg 600, similarly, is extended by means of it screw adjusting collars 603, and locked in place at the desired length. Tilt and rotation are likewise adjusted to match the dimensions of the armchair.

Although the reader is absent in the illustration, it should not be hard to imagine the chair's occupant in place behind an open book, elbows on the arms of the chair behind book stand's support arms 404 and 504, with the lower end of telescoping leg 600 resting towards the front of the chair seat between the lower thighs or knees.

This position of the book stand is desirable for a number of ergonomic reasons. First, as with the table-top position, it allows the hams to be largely free from having to constantly grasp the book. Second, it positions the book in a more ideal position, more directly in front of the face. (While it is possible to hold a book using only one's hands up in front of the face, the arms invariably tire and gravitate with book back into the lap.) This more elevated position is not only better for the eyes, it is easier on the neck as well, as the head can be left in a more natural upright position.

There are a number of other armed chairs to which the stand may be similarly adapted, such as airplane, train, and bus seats.

In those chairs without arms, or the arms of which are too rounded or steep to accommodate the support arms, support arms 404 and 504 could be placed directly on the seat of the chair on either side of the hips or thighs. This would limit somewhat the height to which the stand could be raised; however, it would still be a useful option.

This position is also useful for reading in bed while reclining against a headboard, a wall, or in a positionable bed such as used in hospitals and convalescent facilities. Lower ends of support arms 404 and 504 would rest on the bed, while end of telescoping leg 600 rests also on the surface of the bed between reader's legs.

Book stand may also be cradled in the lap at any seated position, with or without the support of telescoping leg 600. In this case, the chief advantage would be that the book stays flat and open and the pages are firmly restrained.

H. Sideways Position for Reading in Bed

Reading while lying in bed is ordinarily another awkward prospect. As has been discussed in a previous section, it has been the goal of many previous inventors to develop some aid in holding a book in a more comfortable position in bed. This has usually taken the form of some kind of cantilevered support arm attaching to a bed frame or headboard, attached to which might be some kind of book holding frame. The idea was to be able to read flat on one's back, looking up at the book. While this is indeed a desirable position, and will be addressed below, attention will now be drawn to a more simply achieved, and in many ways just as desirable, in-bed reading position.

Since many people find it just as comfortable, if not more comfortable, to lie on one's side in bed rather than flat on one's back. They try reading in this position by manually holding the book open more or less sideways. After a short time, however, it becomes tiring to hold the book, and difficult to keep both left and right pages flat to the angle of view. It make sense to adapt a reading stand to accommodate this reading position.

FIGS. 7A and 7B show how book stand may be configured to hold a book sideways. The left and right support arms 404 and 504 are extended roughly halfway, and rotated to the desired angle corresponding to the angle of view with the head resting on a pillow. Telescoping leg 600 is extended to the appropriate length and is then manually rotated on its axis and tilted to an angle roughly as shown. This rotation is aided by means of grasping upper aluminum tube 601*a* of the telescoping leg 600 with the fingers, and using the thumb to exert pressure on station thumb tab 615.

Using book stand in this sideways position is simply a matter of locating stand on a flat section of the bed near the reader's head. Also, book stand may be set on a night stand or end table near the edge of the bed in sideways position, so that it is comfortably visible to the reader. Operation of page clamps 200 and 300 for page turning is unchanged in this position; pages remain in the open position no matter how steeply face of book is inclined.

Also, should reader desire to lie and read on reader's other side, book stand may be flipped over and place on bed or bedside table on opposite side, using opposite support arm as support. Telescoping leg 600 would simply be rotated to an appropriate opposite position.

This is the first instance of using this rotational ability of telescoping leg 600, and one can now see why it is not mounted to frame 100 in a more direct or simpler way. This also explains the large diameters of reinforcement disc 115 and rotation disc 610, and the wave spring washer friction arrangement. The function of this mounting system is to provide a consistent amount of friction to rotation disc 610, so that it and entire telescoping leg 600 will remain rotated to any desired position under its normal load, while still allowing for manual repositioning.

The actual angle to which book stand frame 100 may be rotated and supported is entirely variable. Virtually any intermediate angle, even upside-down, is achievable through proper adjustments of support arms 404 and 504 and telescoping leg 600.

Should a certain book be wider than the lateral dimensions of book stand, so that outside edges of the book when mounted in book stand protrude beyond the mounting locations of support arms 404 and 504, it is still possible to use the end of a support arm as a prop to support stand in a sideways or intermediate position. It is also possible to rest lateral edge of book cover itself directly on the bed or night stand surface. In any case, use of page clamps 200 and 300 is not impeded, since page clamps will not protrude laterally beyond edge of book's pages.

I. Collapsing Book Stand for Storage and Portability

FIGS. 8A and 8B shows how book stand appears in a collapsed state, with no book resident. Support arms 404 and 504 are positioned crossing each other just below reinforcement disc 115 on backing plate 101 telescoping leg 600 is collapsed to its minimum length and rotated to approximately forty-five degrees as shown, then tilted until rubber foot 604 is in close proximity to lower lateral corner of backing plate 101. With no reading material in place, page clamps 200 and 300 may be slid inwards on rat 104 until clamp bars 222 and 322 engage cover clamps 105 and 106 or laterally protruding sections of backing plate 101. Due to spring force of page clamp mechanism, page clamps 200 and 300 are now securely retained. In this state, the apparatus measures 310 mm wide, 235 mm high, and 105 mm deep. In ABS plastic and aluminum as described in this embodiment, overall weight is approximately 700 grams (1.5 lbs.) This is a size which easily fits into student book bags, knapsacks, shopping bags, etc. It is roughly similar in size, though much lighter than, a medium-size textbook Collapsing book stand while holding reading matter is very similar. In this case, however, it may be desirable to leave page clamps in place at lateral margins of open pages. Book and stand together may be easily stored or transported. It is thus a simple matter to interrupt and subsequently recommence reading, at various different locations and times, with a minimum of bother. It is entirely likely and desirable that a lengthy book may be read in its entirety, over the course of many days or months, and in many different locales, without ever having to remove book from stand.

It can thus be seen that the book stand here presented has been designed to be highly versatile and portable as a self-contained unit. The next section will include detailed descriptions of the configuration and use of additional devices that further extend the usefulness of the bookstand, making an even greater number of desirable reading positions available.

J. Using Book Stand with Flat Panel Electronic Displays

Although no illustration is included for this application, it is not difficult to imagine using book stand, completely unaltered, to support a flat panel electronic display device. While it seems unlikely that such devices will universally replace the printed book any time soon, they are quickly gaining in popularity for the display of computer, video, and electronic communication information. Within the last five years, in fact, one of the largest consumer electronics manufacturers introduced a battery-powered "electronic book" with a digital disc storage system and a flat-panel LCD display. With improvements in resolution, speed, battery life, data storage, and reductions in cost, electronic displays will almost inevitably replace printed matter in increasing numbers. It makes sense, then, for a reading stand such as present in this invention to allow for the easy holding and positioning of conceivable flat panel displays.

We shall make the reasonable assumption that such a display would be similar in size to a laptop computer display, or similar in gross dimensions to a typical closed book. Let us assume a display panel size of 200 mm wide by 200 mm high and having a uniform thickness of somewhere between 20 mm to 50 mm.

Attaching and removing such a display unit to and from book stand is a simple matter. Page clamps 200 and 300 of book stand would be used in this instance to hold display panel in place against frame 100. Assuming book stand is similarly positioned as in FIG. 1, display panel is placed flat against cover clamps 105 and 106, its lower edge resting on or just above lower ledge 103. First one then the other page clamp is slid laterally inward to engage respective outer lateral edge of display unit face. In this way, panel is forcibly held in frame 100 by spring-loaded force of page clamps.

Some existing electronic display devices are fairly narrow in face width. Since page clamps 200 and 300 are removable and may be reversed left for right, however (as previously mentioned,) this poses no problem.

In using book stand to hold such a display device, reading, computing, communications, watching television, and any other uses of an electronic display device may now be enjoyed more comfortably and in many otherwise advantageous positions. All the positioning abilities of book stand as set forth in preceding sections may now be made use of. Book stand and display device together may now be elevated, tilted forward and back, or placed on its side using the three support members. It may be placed in auxiliary floor stand, or other such support brackets. A light unit (as exemplified in a following section) may also be attached should such a display device not have its own built-in illumination. Invalids, arthritis sufferers, and the physically impaired may also benefit in another way from this arrangement: besides not having to hold up display device with the hands, paper pages need not be manually turned as with a printed book.

CONCLUSION

It should now be apparent that the book stand here presented allows a book or other reading material to be read, conveniently and without constant manual support and restraint, in a great number of desirable and heretofore impractical ergonomic positions. More specifically, it has been shown that the book stand provides that:

a) A book or other reading material may be inserted easily into the book stand frame in a flat and open position.

b) Page clamps may be slid easily to appropriate positions at the outside left and right edges of the pages.

c) A page or pages may be held and released at will, so that pages may be turned one at a time in the normal course of reading, and so that many or all pages may be released at once in order to browse more quickly through a large number of pages. The functions of holding a book and holding its pages are thus advantageously divided.

d) Book stand may be positioned on a horizontal surface by means of table support loops and telescoping leg.

e) Book stand may be raised and lowered from such a horizontal surface to a more useful height by using the two support arms in conjunction with the telescoping leg.

f) Book stand may be easily configured to support a book at an arm chair using its support members in more fully extended positions.

g) An open book may be held on its side or in any other spatial orientation made possible by the support members, without the pages failing closed, so that the book is readable in any such position.

h) Page clamps, support arms, and telescoping leg, all collapse either with or without the book still attached and open to its last place of reading, so that the entire stand is compact, portable, and storable.

i) Finally, book stand may be used unaltered as a support stand for flat-panel display devices such those used on lap-top electronic computers, electronic books, and video screens, thus making the stand equally at home with standard printed media as well as with high-technology and conceivable future-technology reading, display, and communication devices.

In following sections, ramifications shown and described will also show that:

j) Book stand is easily attached to additional support stands of various possible configuration, such that an open book or other material is easily positioned in virtually any spatial orientation, including face-down, and that in such positions the pages will still be kept positively open and may still be turned at will.

k)Book stand allows for a light unit with battery pack to be quickly attached beneath its lower ledge, providing near-ideal and unobtrusive illumination of the pages while still preserving portability and convenience.

l) Book stand is part of a book support component system, allowing the components to be marketed individually, keeping price of each component down and enhancing versatility.

RAMIFICATION AND SCOPE

RAMIFICATIONS

A. An Additional Support Arm or Further Reading Positions

The present invention has not been conceived of solely as just a table-top reading stand, nor as just a large extension-arm book-holding apparatus, as are most examples of prior art. The present device has rather been designed as a detachable book stand, versatile and highly portable on its own, but made even more useful when attached to an additional support arm or apparatus.

While there are many possible designs for such an additional positioning apparatus; one such possible design is shown in FIGS. 12A, 12B, and 12C. This is a floor-standing frame with an upright post which is telescoping and thus adjustable in overall height, and having a simple cantilevered, hinged arm. On the end of this arm is a simple screw-adjusted clamping jaw, which is designed to securely grip around the largest aluminum tube 601 a of book stand's telescoping leg 600.

To operate floor stand, first it is set up on a flat level floor, ground or other desired horizontal surface. The two horizontal legs are hinged, allowing the stand to fold flat for storage; when spread out, they form a triangle for three-point stability. The telescoping upright has a simple peg-in-hole, push-button arrangement to fix the height of the upper extension tube. This extension-locking arrangement is already found on a number of commercially available devices such as painting extension poles, photographic stands, etc. A similar function could be achieved by a twist-lock collar as found on book stand's telescoping leg 600, or in a number of other tripod leg extension mechanisms commonly employed. The upper extension of support arm is thus adjustable between approximately one-half to one-and-a-half meters above floor level.

Off the upper terminus of the curved extension tube is pinned or bolted in a two-piece hinged jaw. This clamping jaw may rotate about a vertical axis consisting of the mounting pin or bolt. The contact surfaces of the jaws are contoured with ridges to fit into the previously described linear channels extruded into tube 601*a* of book stand's telescoping leg 600. The jaws are tightened around tube 601*a* by a finger nut attached to a vertical carriage bolt running vertically through the center of each jaw as shown.

When telescoping leg 600 of book stand is firmly clamped in this manner to floor stand, it may now be freely positioned in virtually any spatial orientation, due to the rotation and tilt capabilities of book stand's telescoping leg mounting system. Vertical-axis rotation of floor stand's clamping jaw adds additional positioning articulation. An open book or other reading material now be faced straight up to the sky, straight down, left, right, etc. as well as to any intermediate combination of these angles or directions.

The whole floor-stand-and-book-stand combination may now be placed in any number of desired reading locations. Legs of stand may be slid under a chair or sofa; reader may now relax and read without any encumbrance whatsoever. Moving around and changing seating position will not disturb book stand, nor will presence of book stand's support members restrict movements of reader. Vertical height may be adjusted to suit physique of reader, height of chair, desired angle of view etc.

Floor stand may also be used for reading in bed. FIG. 12C shows floor stand homing book stand and book in a face-down position. Legs of floor stand may be easily slide under bed frame, vertical height adjusted to the proper elevation, and book maneuvered into a desired position in front of supine or recumbent reader. Rotational and tilt adjustment of backing plate on telescoping leg mounting system now allows book stand to be place in virtually any desirable orientation, including sideways. Note also that telescoping leg 600 may be rotated 180 degrees before being clamped into floor stand jaws; since the "tilt" mounting of telescoping leg onto rotation disc 610 is off-center with respect to "rotation" axis, a 180 degree change of rotation may better balance the weight of a large book. This would enable such a large book to remain at the desired "tilt" angle without having to excessively tighten finger nut 632.

As described previously, the friction-disc arrangement of the telescopic leg rotation disc 610 will serve hold book stand in any desired rotational orientation when attached to such an additional floor stand.

Of course, whatever orientation reading material and book stand are given: (1) reading material is positively retained; (2) pages are firmly held and released at will; (3) lateral adjustment of page clamps is easily achieved when necessary; and (4) reading material may be inserted and removed as desired, without detaching book stand from floor stand.

B. Other Types of Support Arms and Stands

In addition to the floor stand described above and in FIG. 12, there are an almost timeless number of designs for floor stands and other types of holding arms, stands, or brackets to which book stand unit conceivably could be attached. For instance: a clamping bracket for attachment to an exercise bicycle or other physical training station; a desktop bracket, similar to that found on a common adjustable-arm clamp-on desk lamp; a bolt-on bracket for permanent attachment to a table, bed frame, or hospital-type bed tray; a bracket for bolting to a wall, enabling a book stand support arm to swing away from a wall near a bed, desk, chair, work area, etc.; a bracket for passenger seats of cars, airplanes, etc.

The important common element to any additional bracket or support frame is that they incorporate some kind of clamp or other means of attachment to telescoping leg 600 or rotation disc 610 of book stand. This will allow the reading material to be easily adjusted to any spatial attitude.

C. Battery-Powered Light Unit

Providing adequate illumination for reading is also important (or a reader's comfort and eye health. While there are a number of small battery powered lights commercially available, the design shown in FIG. 13 and described below provides a near-ideal combination of lighting function, convenience and portability, and integrates with the design of the book stand here presented.

FIG. 13 shows a possible design for a self-contained lighting unit which may be attached to book stand. This unit provides: an oblong battery case for the containment of 4 standard "C" cell electrical batteries; an on-off light switch on right-hand front of battery case; an a.c.-d.c. adapter receptacle on right-hand end of battery case, allowing house current plug to be connected; an approx. 130 mm long pivoting extension tube allowing lamp head to be swung away from or collapsed into face of book stand; an adjustable-angle lamp head with hood and screw socket for a miniature light bulb; two plastic flexible clip-tabs on either end of battery case allowing light unit to be attached to and detached from bottom or lower ledge 103 of book stand, using interior circumferences of table support bops 107 and 108 as capturing members.

This light unit has been designed to nestle into the lower section of book stand, and to provide near-ideal illumination of reading material in an unobtrusive way. Light fails only on book for discrete reading without disturbing others. Light follows book stand no matter what spatial orientation it is placed in. Lamp arm and head are fully adjustable and swing in to face of backing plate 101 (or book pages when present) to preserve portability. Unit snaps easily onto frame 100 and may quickly be detached if desired. Battery case is open and accessible when removed, allowing easy replacement of batteries. Unit could be made of light-weight plastic and presents a minimum of manufacturing difficulty.

SCOPE

The device depicted in the drawings and described thus far above is simply one conceivable embodiment of the invention. This should not be construed as limiting the scope of the invention to the given examples.

A. Intended Use

The intended use of the invention is generally for the presentation and positioning of books, magazines, periodicals, binders, pamphlets, and any other format of bound or unbound paper reading matter. However, it is more broadly intended that the invention also may be used with any kind of visual display material, including but not limited to the following: signs, posters, and menus; photographs, drawings, illustrations, paintings, flat or two-dimensional art displays; electronic display devices such as computer monitors, liquid crystal displays, and flat-panel televisions; mirrors which reflect visual images for visual display purposes, whether from the aforementioned sources or from some other source, etc.

B. Construction Materials and Dimensions

Materials for forming various parts of book stand could be any of various light, strong, easily manufactured materials. While it would not appear economically advantageous, it would certainly be possible to make bookstand frame 100, for instance, out of aluminum, magnesium or some other metal alloy; fiberglass or other composite material; acrylic, styrene, polyethylene, nylon or many other plastic formulations; plywood, hardboard, cardboard, or other wood or cellulose product, etc. The same goes for virtually all of the parts described herein. Materials could be mixed for whatever reason. For instance, it might be desirable from a manufacturing or economic standpoint to make some parts out of molded ABS plastic, some out of extruded aluminum, and still others from styrene.

Dimensions of virtually all parts, gross outline shapes, thicknesses of materials, etc. could vary widely. The entire device could be substantially larger or smaller, according to how large a book or other material it would be intended to hold. Lengths of support members such as support arms 404 and 504 and telescoping leg 600, could be made longer or shorter depending on preferred maximum display height attainable. The overall size and particular dimensions of the described embodiment of the invention are simply those that seem to afford a good balance of functional size, light weight for portability, and strength to prevent sagging or breaking.

C. Functional Components and Their Equivalents

It must be stressed that the value of the invention lies not so much in the particular design of individual parts and assemblies, but in the arrangement and juxtaposition of various specific functional elements in a new and useful way. Taken individually, few of the parts of the present embodiment have a terribly revolutionary shape or function. Sliding carriers on rails, pivoting adjustment arms, spring loaded clamps, rotational friction devices, etc. have all been used in the past in various configurations on countless functional items. One could use any number of similar devices, many of which have been put to good use in prior art. Each particular section and individual part of the invention could vary substantially not just in size or appearance but in basic design as well. In the following paragraphs, a number of alternate designs for particular parts and assemblies will be offered.

i. Bookstand Frame 100

Rigid backing plate 101 could be of various thicknesses and perimeter shape. The shape shown is simply one that we feel represents an economy of material and the minimal size and shape necessary for supporting a wide variety of book sizes.

The two cover clamps 105 and 106 serve as a simple means of holding a book firmly in place on backing plate 101. An alternate method might be desirable for various reasons, for example in order to limit the complexity of a manufacturing process or mold. Various methods for holding a book to a separate frame have been proposed and used over the years, such as a single removable metal rod fitted vertically in front of the open book's spine, with some pages falling on one side of rod and some on the other. This is a method already used to hold magazines in protective plastic covers for use in a public library, for instance. The lower end of the rod could project into a hole in the face of lower ledge 103, while the upper end could have a simple "U" shape bent into the end, hooking back down over top edge of backing plate 101 as rod is inserted into hole. Alternately, two removable rigid rods or leaves could be used instead of one, fastened down on book covers or spine on either side of pages. The drawback to this method is that the parts are separate and so may come loose or get lost or damaged.

Further, it is important to note that book stand as otherwise herein described would function quite well without any book cover clamp whatsoever. The absence of such cover clamps would not alter the functionality or novelty of any of the other mechanisms in any way. The page clamp assemblies as here described are more than adequate to hold most books in place even if stand and book are inverted. However, any book stand is improved by the inclusion of such simple book cover clamps.

Book ledge 102, which serves to raise bottom edge of book or other reading material out of the way of page clamp mechanisms, could be of various dimensions. It could be shortened or virtually eliminated if the rail and slider unit were designed in an appropriate compensating manner, the only requirement being that the design obviously must give adequate clearance between lower area of reading material and functioning area of page clamps.

Slide rail 104 as shown is what we feel embodies the simplest example of a linear guidance device or linear bearing. The simple rectangular lip shape is easy to manufacture as one piece with the rigid panel; it could easily be molded of plastic or extruded of aluminum, for instance. However, the cross-sectional shape could easily be changed if desired to a curved arc, a hexagon, a circle, or any number of other shapes. The sole functional requirements are that it contains motion in a lateral direction and prevent any other linear or rotational motion. It could also take the form of a slot rather than a rail, with slider 211 correspondingly exchanged from an exterior wrap-around design to an interior-fitting one. For instance, a T-section page clamp slider fitting inside a milled-out or extruded T-slot "rail."

Sliders 211 and 311 could even be configured to ride on linear ball bearings or a set of roller wheels, much like a sliding door or gate. Though this seems unnecessarily complicated and less economical to manufacture, it could in some way be advantageous. The length of rail 104 is shown as approximately 300 mm. But this length could vary according to size of intended reading material, configuration and dimension of page clamps sliders 211 and 311, and according to the desired compactness of the reading stand when collapsed.

ii. Page Clamps 200 and 300

There are likewise a number of different ways to configure a suitable page clamp. Lever unit 220 which we have shown as an "L" shape could easily be a simple straight lever, or any shape so long as it fills the essential goals, which are to hold the page firmly, to have some tab or finger lever (or manual release of pages when so desired, and to not obscure the words or other material printed on the page. One obvious alternate design would be to have a straight lever pivoting from a horizontal axis (i.e. an axis parallel with slide rail 104.) This axis would most likely be located toward the outward lateral end of each page clamp slider. Such a clamping lever might be similarly sprung with a torsion or other spring. The drawback to this design would be that the angle of clamping bar would change with respect to surface of page as it is rotated about its axis. Likely only the end, or at any rate a small portion, of such a clamping bar would contact the page at any given time. As they are shown configured, the page-side surfaces of clamp bars 222 and 322 are always parallel with (and thus fully in contact with) surface of page.

It is also not entirely necessary that page clamp mechanisms use a metal spring for torsion spring 238, or for that matter a torsion spring. A coil compression or tension spring could be used pushing or pulling between face of spring cover 225 and slider 211, for instance. Simple plastic springs have been used in many cases, as on simple hinged clips for plastic bags widely available in grocery stores. As new plastics and other materials are developed, a simpler or longer lasting material or physical design for a spring mechanism might well be advantageous. For that matter, a page clamp and slider could be made in one piece, molded out of an extremely flexible and springy metal or plastic, thus dispensing with separate springs, axles, assembly clips, etc.

The function of a metal axle pin with machined ring grooves as shown in pins 231 and 331 could be similarly achieved by using a plastic pin cast as a single piece with slider unit 210 (and 310). Necessary strength might be achieved by increasing diameter of pin somewhat. Also, axle pins could be located on lever units 220 and 320, with bearings 224 and 324 conversely located on slider units 210 and 310, instead of the reverse as shown. Retaining rings 233, 236, 333, and 336 could be replaced with a number of other of common shaft or pin retaining devices, such as: a three-pronged press-on retaining clip; a cotter pin through holes in the end of the shaft; a split-ring or wire-ring though shaft end holes. Also, one end of pins 231 and 331 could easily have a shoulder rather than a separate retaining mechanism. This would mean fewer parts to assemble or possibly come loose. Washers 234, 237, 334 and 337 could also conceivably be eliminated altogether if a broad enough retaining ring is used to prevent possible deterioration of bearing faces.

Finger tabs 223 and 323 could have a much different shape, and need not extend the entire length of clamp bars 222 and 322. The contact face of clamp bars 222 and 322 could be coated or inlaid with a soft rubber to give better grab or traction with the surface of the page.

iii. Support Arms and Mountings

Support arms 404 and 504 are each shown as a simple flat bar with a slot along much of its length. Any number of other types of adjustable length arms could be used. A simple solid rod of round cross-section could be used. This could be mounted via a simple round bar clamp using the existing screws 401 and 501. Such a bar clamp might be of similar design to those made for holding accessories to bicycle tubes.

The interlocking toothed-disc-and-washer adjustment system (toothed discs 109 and 110 mating with toothed washers 402 and 502) is simply a way of securing support arras 404 and 504 against rotation when tightened. This mechanism could take a number of alternate forms. Instead of radial teeth, a pattern of rounded dimples mating with a pattern of round bumps could be formed into the mating discs and washers. Or, disc and washer could be smooth surfaces coated with soft rubber, which, when tightened under pressure of finger nuts 407 and 507 would resist both linear and rotational motion.

iv. Telescoping Leg and Mounting

As has been stated earlier, telescoping leg 600 is a pre-existing part of fairly common design. Any alternate design as used on other types of tripod legs and other support devices could easily be substituted. Wooden tripods use a system of two beam members sandwiching a third adjustable member, the position of which is held by a simple friction screw threaded into one of the two sandwiching beams. Within the telescoping-tube designs, many different tube cross-sectional shapes have been used, and there have been numerous mechanisms to lock each leg section with respect to another. Quick release cam levers have been used in various configurations, as have thumb-screw type friction collars. An adequate leg, whatever the design, should be adjustable in length within the desired range, should collapse to a length allowing unobtrusive storage and transport, and should have the strength necessary to support weight of stand and book or display material without bending or collapsing.

The rotation and tilt mounting configuration of rotation disc 610 allows the leg to be positioned for supporting frame 100 as a tripod, and allows for a universal adjusting mount when leg is mounted in an auxiliary floor stand. There are a number of other suitable arrangements for such a mechanism, some of which are also suggested by prior art camera tripods. A friction ball-and-socket joint is still a popular device used in a number of variations as a tripod head, allowing the camera to be tilted and rotated to virtually any angle. Typically, there is a friction thumbscrew or cam-lever which squeezes and releases the ball within the socket. A ball-and-socket joint of the size necessary to support the weight required here, however, would likely prove bulky, take more screw tension to tighten, and be more difficult to manufacture.

The spring-loaded friction maintenance device in mounting rotation disc 610 is not absolutely necessary. It could be eliminated in favor of yet another screw-and-finger-nut arrangement. It is simply a matter of convenience (a finger nut in this position would be somewhat difficult to operate,) and also saves some space while simplifying operation. The rivet, being permanent, will never inadvertently come loose as screws can. In this regard, one could also make a case for substituting a similar constant-friction, riveted mounting in place of carriage bolt 631 and finger nut 632 for the "tilt" axis of telescoping leg 600. Also, a screw and locknut could be substituted for rivet 633, or even a removable shaft with ring clips as used on page clamp pins 231 and 331.

The fact that mounting ears 611 and 612 are mounted off-center of rotation disc 610 is not an essential detail. It simply serves to position telescoping leg 600 rotation pivot (rivet 633) in a good position on flag 100 to balance the borne weight of a typical book. This positioning simultaneously allows telescoping Leg 600 when fully collapsed to be rotated to an unobtrusive position for storage and transport. The essential problem in this design geometry is to have telescoping leg 600 be as long as possible when fully extended, as short and unobtrusive as possible when fully collapsed, and mounted in the most advantageous place possible. The geometric solution in the embodiment shown is one solution to this problem, though certainly not the only one conceivable. It would be possible, for instance, to use a simpler telescoping leg with a total of only three or even two collapsing sections rather than four, if a design for the adjustment collars could be found which allowed each section to extend more fully.

The three finger nuts 407, 507 and 632 used to adjust support arms 404 and 504 and telescoping leg 600 could be replaced with a fastener similar to the cam-lock-with-lever variety, such as those commonly used to secure quick-release bicycle axles. This might allow faster and easier adjustment of the various support members.

It should be clear from the previous examples that the invention is concept which could satisfactorily take many embodiments. Thus, the scope of the invention should be determined by the appended claims and their legal equivalents, rather than by the examples given.

We claim:

1. A book holder for homing reading material, visual display material or visual display devices, comprising:

(a) a rigid panel;

(b) a perpendicular lower ledge protruding from said rigid panel;

(c) one or more panels protruding from said lower ledge parallel with said rigid panel;

(d) a means for guiding and containing linear lateral motion, protected perpendicularly downward from said lower ledge of said rigid panel;

(e) one or more sliding carriers which are guided and contained by said means for guiding and containing linear lateral motion, such that at least one sliding carrier may be guided into a position adapted to be in a suitable proximity to a lateral edge of the reading material; said sliding carrier including four integral panels, a top, front, bottom and rear panel forming a G-shaped cross section; a pivoting pin mounting tab having a hole is attached to said front panel;

(f) a lever, having a horizontal extension arm and a flat rectangular clamp bar, mounted upon said pivot pin mounting tab of each sliding carrier by a pivoting means, whereby a portion of said lever is allowed in pivot relative to said sliding carrier, adapted to describe motion towards and away from the face of said rigid panel and the reading material mounted thereupon;

(g) a force biasing means of said lever and said sliding member, such that a portion of said lever is forcible against the visual material placed between said lever and rigid panel.

* * * * *